US009404274B2

(12) United States Patent
Maiuccoro

(10) Patent No.: US 9,404,274 B2
(45) Date of Patent: Aug. 2, 2016

(54) POOL STAIR FORMS AND METHODS OF FORMING STAIRS

(71) Applicant: Imperial Pools, Inc., Latham, NY (US)

(72) Inventor: John V. Maiuccoro, Albany, NY (US)

(73) Assignee: Imperial Pools, Inc., Latham, NY (US)

( * ) Notice: Subject to any disclaimer, the term of this patent is extended or adjusted under 35 U.S.C. 154(b) by 0 days.

(21) Appl. No.: 14/751,474

(22) Filed: Jun. 26, 2015

(65) Prior Publication Data

US 2015/0292218 A1 Oct. 15, 2015

Related U.S. Application Data

(60) Continuation of application No. 14/618,474, filed on Feb. 10, 2015, now Pat. No. 9,080,338, which is a division of application No. 14/068,933, filed on Oct. 31, 2013, now Pat. No. 8,950,155.

(60) Provisional application No. 61/722,012, filed on Nov. 2, 2012.

(51) Int. Cl.

| | |
|---|---|
| ***E04B 1/00*** | (2006.01) |
| ***E04G 13/06*** | (2006.01) |
| ***E04F 11/00*** | (2006.01) |
| ***E04H 4/00*** | (2006.01) |
| ***E04H 4/14*** | (2006.01) |
| ***E04B 1/16*** | (2006.01) |

(52) U.S. Cl.

CPC ..... *E04G 13/062* (2013.01); *E04B 1/166* (2013.01); *E04F 11/00* (2013.01); *E04H 4/0075* (2013.01); *E04H 4/144* (2013.01)

(58) Field of Classification Search

CPC ..... E04G 13/062; E04H 4/144; E04F 11/00

USPC ..... 52/741.2, 169.7, 169.8, 182–184

See application file for complete search history.

(56) References Cited

U.S. PATENT DOCUMENTS

| | | | | | |
|---|---|---|---|---|---|
| 3,478,370 | A | * | 11/1969 | Purpuri | E04F 11/16 52/188 |
| 4,343,120 | A | * | 8/1982 | Witte | E04H 4/144 52/169.7 |
| 5,010,699 | A | * | 4/1991 | Maiuccoro | E04F 11/025 182/93 |
| 5,086,595 | A | * | 2/1992 | Maiuccoro | E04F 11/00 52/183 |
| 5,107,640 | A | * | 4/1992 | Gefroh | E04F 17/06 52/107 |
| 5,186,874 | A | * | 2/1993 | McLaughlin | E04G 13/06 249/14 |
| 5,752,350 | A | * | 5/1998 | Maiuccoro | E04H 4/144 52/169.7 |
| 5,941,030 | A | * | 8/1999 | Williamson | E04H 4/144 4/506 |
| D431,303 | S | * | 9/2000 | Maiuccoro | E04H 4/144 D25/69 |

(Continued)

*Primary Examiner* — Mark Wendell

(74) *Attorney, Agent, or Firm* — Heslin Rothenberg Farley & Mesiti P.C.; Nicholas Mesiti; Kristian Ziegler

(57) ABSTRACT

The disclosure provides for pool step forms and related methods for forming steps in a pool formed by wall panels. The step forms may include a wall panel insert configured for insertion between adjacent pool wall panels. The step forms may include one or more step form brace configured to couple with the wall panel insert and, thereby, the wall panels. The step forms may include riser forms that from riser portions of the stairs when the step forms and riser forms are coupled. The pool stair forms may be filled with filling material to form tread portions of the stairs. The pool stair forms may include liner support members coupled to the step form braces and/or the wall panels that facilitate the coupling of a liner to the stairs formed by the pool stair forms and filling material.

32 Claims, 12 Drawing Sheets

(56) References Cited

U.S. PATENT DOCUMENTS 7,150,129 B2 * 12/2006 Elder ..... E04H 4/144
4/488

9,080,338 B2 * 7/2015 Maiuccoro

2011/0078962 A1 * 4/2011 Gravel ..... E04H 4/144
52/169.7

* cited by examiner

POOL STAIR FORMS AND METHODS OF FORMING STAIRS

CROSS REFERENCE TO RELATED APPLICATIONS

This application is a continuation of U.S. patent application Ser. No. 14/618,474, filed Feb. 10, 2015, which is a divisional application of U.S. patent application Ser. No. 14/068,933, filed on Oct. 31, 2013, issued as U.S. Pat. No. 8,950,155 on Feb. 10, 2015, which claims priority from U.S. Provisional Patent Application No. 61/722,012, filed on Nov. 2, 2012, the entire disclosures of which are hereby expressly incorporated herein by reference.

FIELD OF THE INVENTION

The present invention generally relates to the field of pool stair forms, and, in particular, to devices and methods for forming stairs in pools constructed from modular panels.

BACKGROUND INFORMATION

A swimming pool, swimming bath, wading pool, paddling pool, or simply a "pool," can generally be described as a structure, enclosure or container filled (or capable or designed to be filled) with water and otherwise arranged for swimming or wading by a user. Pools are used for relaxation, amusement, therapy, training, recreation and the like. Pools that may be used by many people or by the general public are called generally referred to as public pools, while pools used exclusively by a few people or in a home are called private pools.

Both public and private pools are constructed in a myriad of sizes, shapes, types and styles. Generally speaking, pools are either substantially recessed within the ground or floor of the area including the pool (referred to as "inground" pools), constructed on the top surface of the ground or floor of the area including the pool (referred to as "above ground" pools) or are partially recessed within the ground or floor of the area including the pool such that the bottom of the pool is below grade and the top of the pool is above grade (referred to as "semi inground" pools). Although the type of pool (inground, above ground and semi inground) generally dictates the type of construction and materials used to form the pool, numerous options and variations still exist on the market.

Above ground and semi inground pools are typically constructed, at least partially, of gunite or concrete, fiberglass or prepackaged materials. Installation of gunite or concrete swimming pools can include excavating and constructing reinforcement materials (e.g., rebar) into almost any form dictating the shape the pool. Then the gunite or concrete material is poured or otherwise transferred into the form. The interior of the cured gunite or concrete can be finished with plaster, stone, glass, paint, tile, etc. Accordingly, installation of gunite or concrete swimming pools can take several months and they are very costly both to construct and maintain. Fiberglass swimming pools, alternatively, are one-piece shells that can be "dropped in" to a prepared surface in a very short period of time. However, as fiberglass swimming pools are preformed, they are limited to the shapes and sizes currently offered by manufactures. Further, fiberglass swimming pools are generally expensive and can are prone to shifting or heaving in extreme wet or frost conditions.

Packaged pools on the other hand are easy to maintain, typically less expensive than gunite and fiberglass pools, can be formed into many shapes and designs, are engineered to standards, include a relatively short installation time and can be repaired and maintained quickly and inexpensively. Packaged swimming pools consist of components, including wall panels, supports, braces and a liner, that are assembled together to on site create the swimming pool. The two most popular base materials for the components are steel and polymer. Packaged swimming pools are typically "engineered," meaning they are designed and produced to predefined standards in a controlled factory environment. As a result, packaged swimming pools, and in particular polymer based packaged swimming pools, have become a popular and preferred method of swimming pool construction.

Currently, there are several options for constructing stairs and other structures in packaged swimming pools for ingress and egress to the pool. For example, permanent interior steps and or benches are often built on site by constructing a form. The step or bench form is filled with concrete or the like and, when the concrete has set and dried, the step or bench form is removed. The cost of manufacturing concrete steps is expensive because it is labor intensive process, requiring highly skilled workers for construction. A concrete step, however, is advantageous in that it strong, durable and maintenance free. A problem is presented when concrete steps are used in pools with vinyl liners, such as packaged pools, because it is difficult to accurately measure and build a conforming liner to cover the concrete steps due to the variability and the unique shapes and sizes of poured concrete steps.

As an alternative, one-piece pre-formed steps are often used. Pre-formed steps are typically made from molded plastic, acrylic, fiberglass laminates and vinyl covered metal. While pre-preformed steps may be relatively strong, at least initially, they tend to delaminate, splinter, corrode, puncture or otherwise deteriorate over time in a pool such that their structural integrity is compromised. Also, some pre-preformed stairs or steps, such as some plastic pre-preformed stairs, are relatively flexible such that they yield under a user's weight and thereby feel insecure or unsteady. Further, in order for pre-preformed steps to fit properly the pool must be constructed without imperfections.

Accordingly, it is an object of the present invention to overcome one or more of the above-described drawbacks and/or disadvantages of the prior art.

SUMMARY OF THE INVENTION

The present disclosure is directed to devices and methods for forming stairs in pools. The disclosed devices and methods have particular utility with pools formed by modular wall panels.

In accordance with one aspect of the present disclosure, a pool stair form for forming stairs in a pool including pool wall panels is disclosed. The pool stair form includes at least one pool wall insert configured to be coupled between adjacent pool wall panels. The pool stair form further includes at least one stair form brace configured to couple to the at least one pool wall insert and extend therefrom in a first direction, the at least one stair form brace including first fixation points. The pool stair form further includes a plurality of elongate riser forms including a front face and second fixation points at least a first end thereof. The at least one stair form brace and riser forms are configured to couple at the first and second fixation points such that the riser forms extend in a second direction substantially contrasting the first direction and span substantially between opposing pool wall panels when the at least one stair form brace is coupled to the at least one wall panel insert. The front face of the riser forms form the riser portion of the stairs when the riser forms are coupled to the at least one stair form brace and the at least one stair form brace is coupled to the at least one wall panel insert.

In accordance with another aspect of the present disclosure, a pool stair form for forming stairs in a pool including radiused pool wall panels is disclosed. The pool stair form includes at least one pool wall insert configured to be coupled between opposing sides of the radiused pool wall panels. The pool stair form further includes a center stair form brace configured to couple to the at least one pool wall insert and extend therefrom a first width in a first direction extending substantially along a radius defined by the radiused pool wall panels. The center stair form brace includes first fixation points. The pool stair form further includes a left stair form brace configured to couple to the pool wall panels on a first side of the at least one pool wall insert and extend therefrom a second width in the first direction. The left stair form brace includes second fixation points. The pool stair form further includes a right stair form brace configured to couple to the pool wall panels on a second side of the at least one pool wall insert opposing the first side thereof and extend therefrom the second width in the first direction. The right stair form brace includes third fixation points. The pool stair form further includes a plurality of elongate riser forms including a front face and fourth fixation points at least a first end thereof. The first width of the center stair form brace and the second width of the left and right stair form braces are configured such that when they are coupled to the wall panel insert and the wall panels, respectively, the first, second and third fixation points thereof are substantially aligned in a second direction substantially contrasting the first direction. The center, left and right form braces and the riser forms are configured to couple to each other at the first, second and third fixation points and the fourth fixation points, respectively, such that the riser forms extend in the second direction and span substantially between opposing pool wall panels when the center and left and right stair form braces are coupled to the wall panel insert and the wall panels, respectively. The left and right stair form braces are configured to couple to the first ends of pairs riser forms on one side thereof and the center stair form brace is configured to couple to second ends of the pairs of riser forms on opposing sides thereof. The front face of the riser forms form the riser portion of the stairs when the riser forms are coupled to the stair form braces and the at least a pair of stair form braces are coupled to the at least one wall panel insert.

In accordance with another aspect of the present disclosure, a method of forming pool forming stairs in a pool including pool wall panels with a pool stair form is disclosed. The method includes providing at least one pool wall insert configured to be coupled between adjacent pool wall panels. The method further includes providing at least one stair form brace configured to couple to the at least one pool wall insert and extend therefrom in a first direction, the at least one stair form brace including first fixation points. The method further includes providing a plurality of elongate riser forms including a front face and second fixation points at least a first end thereof. The at least one stair form brace and riser forms are configured to couple at the first and second fixation points such that the riser forms extend in a second direction substantially contrasting the first direction and span substantially between opposing pool wall panels when the at least one stair form brace is coupled to the at least one wall panel insert. The front face of the riser forms form the riser portion of the stairs when the riser forms are coupled to the at least one stair form brace and the at least one stair form brace is coupled to the at least one wall panel insert.

Other objects, aspects and advantages of the pottery holding devices of the present invention, and/or of the currently preferred embodiments thereof, will become more readily apparent in view of the following detailed description of the currently preferred embodiments and the accompanying drawings.

BRIEF DESCRIPTION OF THE DRAWINGS

FIGS. 3A and 3B are perspective views of exemplary riser forms of the first exemplary embodiment of the pool stair form of; FIG. 1

DETAILED DESCRIPTION OF PREFERRED EMBODIMENTS

Each embodiment presented below facilitates the explanation of certain aspects of the disclosure, and should not be interpreted as limiting the scope of the disclosure. Moreover, approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value. When introducing elements of various embodiments, the articles "a," "an," "the," and "said" are intended to mean that there are one or more of the elements. The terms "comprising," "including," and "having" are intended to be inclusive and mean that there may be additional elements other than the listed elements. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. The term "coupled" and like terms are used herein to refer to both direct and indirect connections. Any examples of operating parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

Figure 1:
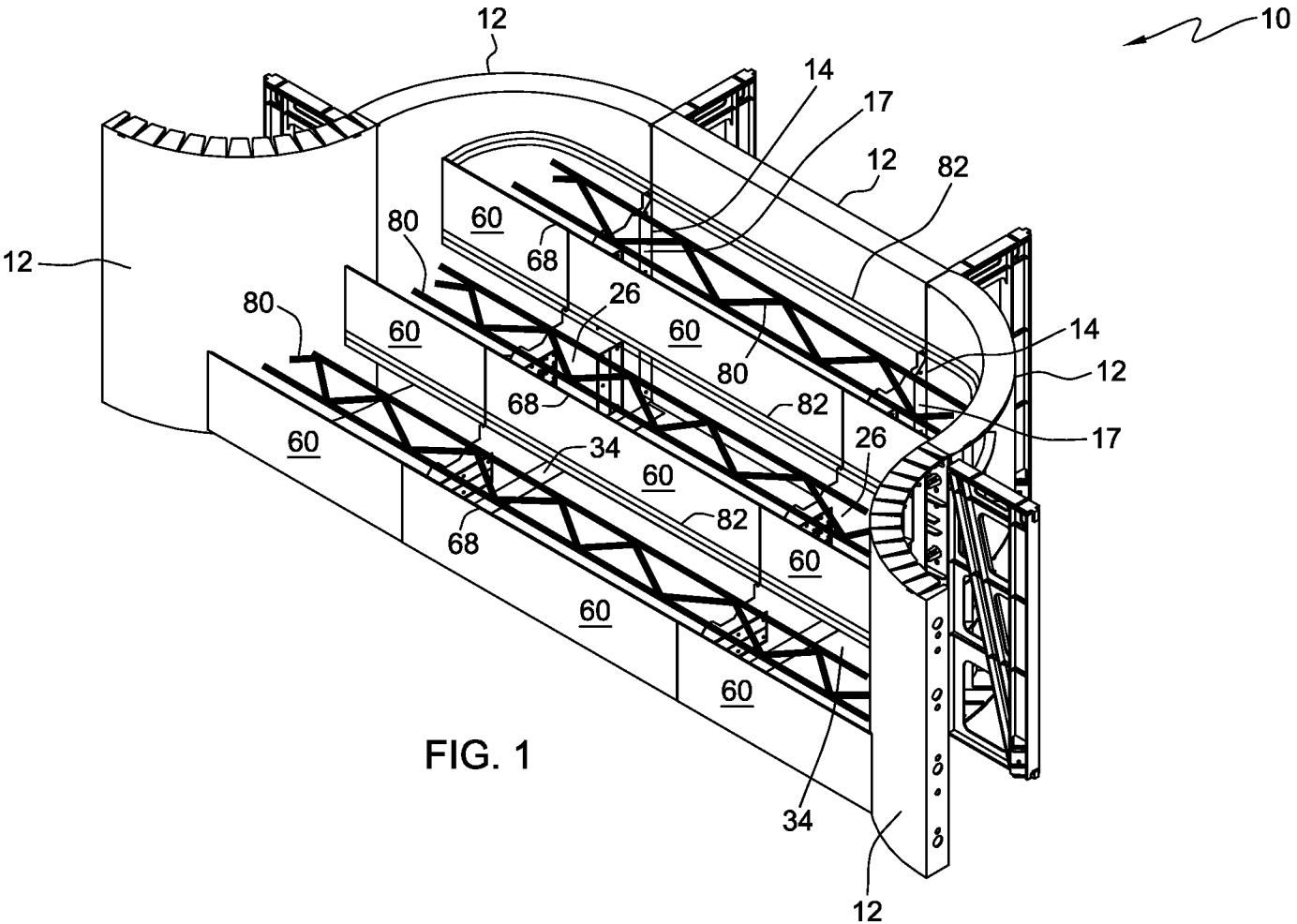
FIG. 1 is a perspective view of a first exemplary embodiment of a pool stair form.
Figure 2:
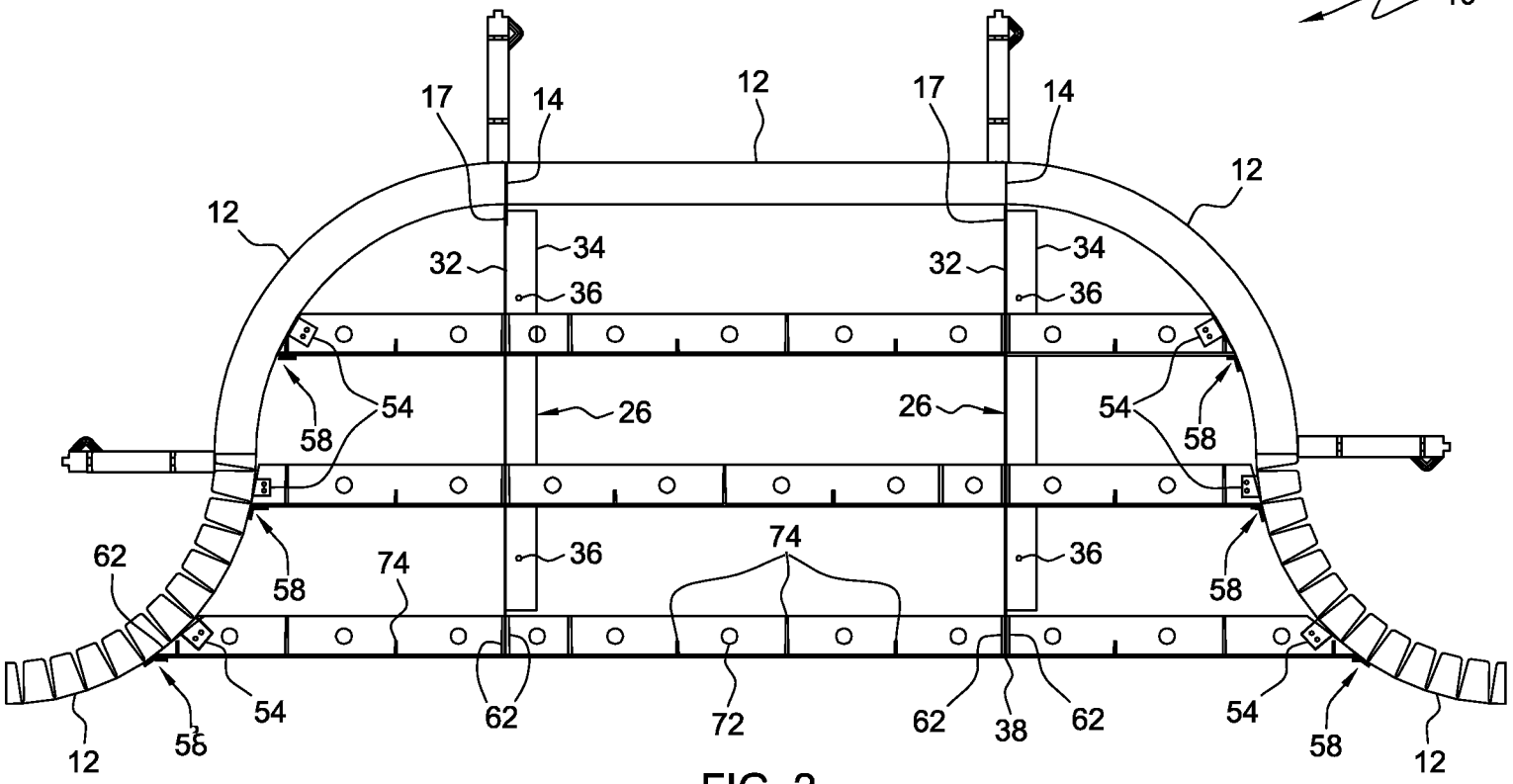
FIG. 2 is a top view of the first exemplary embodiment of the pool stair form of FIG. 1.

In FIGS. 1-6, a pool step form embodying a first embodiment of the present invention is indicated generally by the reference numeral 10. As shown in FIGS. 1 and 2, the pool step form 10 may be configured for use with packaged swimming pools including modular or prefabricated side wall panels 12. The side wall panels 12 may be made from any material and may be formed or deformed into any shape. For example, in the illustrated embodiment in FIGS. 1 and 2 the side wall panels 12 interacting with the pool step form 10 are formed of plastic and include a substantially planar panel and panels that are curved or radiused to form an alcove or extended portion of the pool to house steps for egress and ingress of the pool. In some embodiments, the substantially planar panel and the radiused panels may be made from differing materials. For example, in some such embodiments the planar or straight panel or panels may be formed from one or more polymer(s)-polystyrene resin, and the radiused panels may be formed from adaptable polypropylene. In some embodiments, the pool wall panels 12 may be components of the Matrix Pool Systems manufactured and sold by Imperial Pools Incorporated of Latham, N.Y. For example, at least the deformable radiused panels may be Versa Flex panels of Imperial Pools Incorporated.

A combination of straight panels and radiused or curved panels may be utilized to form to any desired curve or contour, and a pool step form 10 may be configured to be utilized therewith to form, at least in part, stairs therein. As discussed above, the illustrated exemplary embodiment shown in FIGS. 1 and 2 includes a planar wall panel 12 and pairs of opposing radiused panels 12 that form a symmetric alcove or extended portion of the pool to accommodate or contain stairs. In such an embodiment, as shown in FIGS. 1, 2, 5 and 6, the exemplary illustrated pool step form 10 may include at least one wall panel insert 14 coupled in the seam between adjacent wall panels 12. In the illustrated exemplary embodiment, the pool step form 10 includes two wall panel inserts 14. More particularly, the illustrated exemplary step form 10 includes a panel insert 14 coupled in each of the seams between the planar or straight wall panel 12 and the adjacent radiused wall panels 12.

Figure 5:
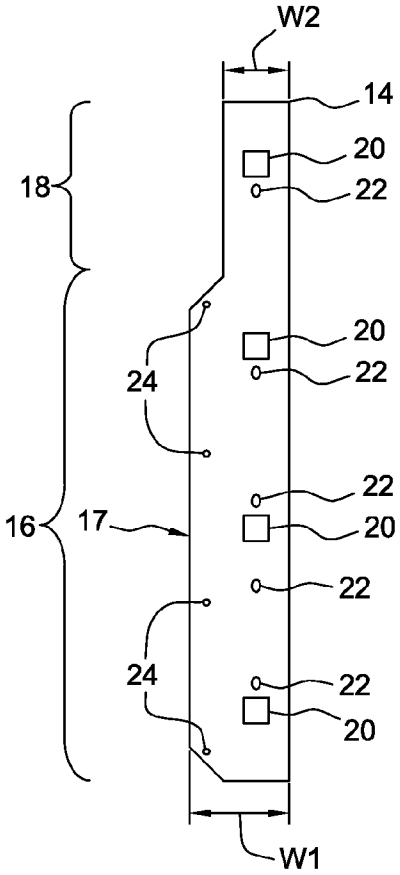
FIG. 5 is a side view of an exemplary pool wall insert of the first exemplary embodiment of the pool stair form of FIG. 1.
Figure 6:
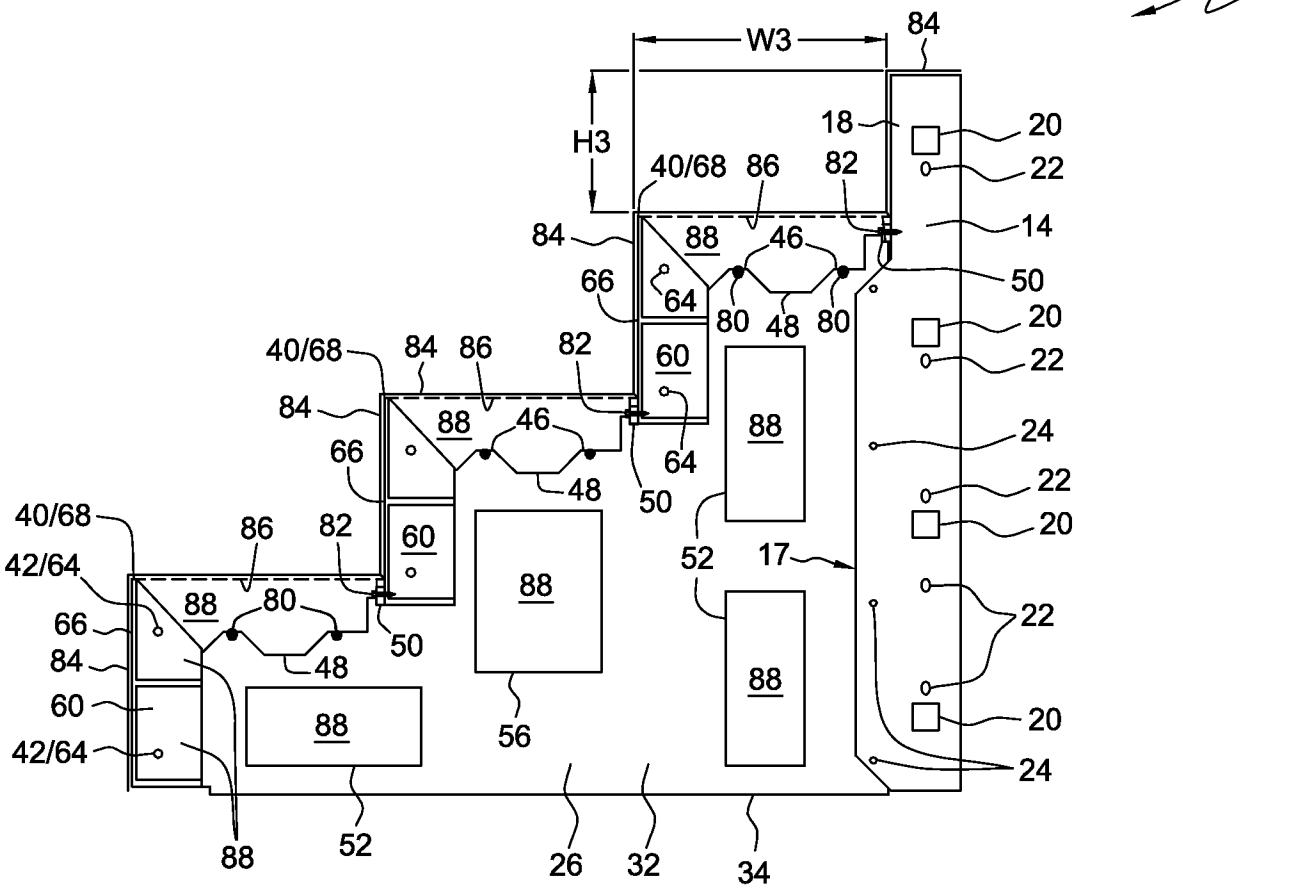
FIG. 6 is a side cross-sectional view of the first exemplary embodiment of the pool stair form of FIG. 1 including a liner and filling material forming exemplary pool stairs.

As shown in FIGS. 1, 2, 5 and 6 each wall panel insert 14 may be substantially planer, elongate, relatively thin and otherwise configured to be secured between adjacent wall panels 12. In some embodiments, the wall panel insert 12 may be formed from sheet metal, such as cut or "punched" from sheet metal. As best shown in FIGS. 5 and 6, the wall panel insert 14 may include a relatively wide lower portion 16 and a relatively narrow upper portion 18. The width W1 and shape of the lower portion 16 may be greater than the corresponding width and shape of the adjacent wall panels 12 between which the wall panel insert 14 is inserted and secured. In some embodiments, the width W1 of the lower portion 16 of the wall panel insert 14 is about 6 inches and the corresponding width of the wall panels 12 is about 4 inches. In such an embodiment, an outer side of the wall panel insert 14 may be substantially aligned with the outer side of the wall panels 12 between which the wall panel insert 14 is inserted and secured such than an inner tab portion 17 of the of the lower portion 16 of the wall panel insert 14 extends past the interior side of the wall panels 12. Thereby, when the wall panel insert 14 is coupled in the seam between adjacent wall panels 12 the inner tab portion 17 of the wall panel insert 14 is exposed within the interior of the pool. As shown in FIGS. 1, 5 and 6 the inner tab portion 17 of the wall panel insert 14 may include apertures or fixation points 24. The apertures 24 of the wall panel insert 14 may facilitate the coupling of other components of the pool step form 10 to the wall panel insert 14 and, thereby, the wall panels 12, as described below.

The width W2 and shape of the upper portion 18 of each wall panel insert 14 may be substantially the same or less than the corresponding width and shape of the adjacent wall panels 12 between which each wall panel insert 14 is inserted and secured. In some embodiments, the width W2 of the upper portion 16 of the wall panel insert 14 is about 4 inches and the corresponding width of the wall panels 12 is about 4 inches. In such an embodiment, the wall panel insert 14 may be positioned substantially within the seam of the wall panels 12, as shown in FIG. 1. As shown in FIGS. 1 and 6, the wall panel insert 14 may be configured such that the lower portion 16 is positioned substantially within or below the pool step form 10 and the upper portion 18 extends from within the pool step form 10 towards the top on the wall panels 12. The upper portion 18 may or may not extend to the top of the wall panels. For example, the upper portion 18 of the wall insert 14 may extend to a height below that of the top of the wall panels 12. In this way, the inner tab portion 17 of the lower portion 16 of the wall panel insert 14 may be contained within the stairs formed from the pool step form 10, and the remaining portions of the wall panel insert 14 may be hidden within the seam of the wall panels 12 as shown in FIGS. 1,2 and 6.

With reference to FIGS. 5 and 6, the portion of the wall panel insert 14 opposing the inner tab portion 17 (the portion adjacent the outer side of the wall panel insert 14), spanning both the lower portion 16 and upper portion 18 of the wall panel insert 14, may include at least one of first apertures or fixation points 20 and second apertures or fixation points 22. The first and second apertures or fixation points 20, 22 may be configured to facilitate insertion and coupling of the wall panel insert 14 within a seam of adjacent wall panels 12. For example, the first and second apertures 20, 22 may be positioned and sized to correspond to corresponding apertures (not shown) in the sides of the adjacent wall panels 12. In some such embodiments, the first apertures 20 may be sized and positioned to correspond to peg or other fastener apertures (not shown) in the sides of the adjacent wall panels 12. In this way, adjacent wall panels 12 and the wall panel insert 14 therebetween may be coupled by the peg or other fastener designed to couple the adjacent wall panels 12 together. In some such embodiments, the wall panels 12 may be panels of the Matrix Pool Systems of Imperial Pools Incorporated, and the first apertures 20 of the wall panel insert 14 may be positioned, sized and otherwise configured to operably couple to the wall panels 12 via the Versa-Loc peg and wedge of the Nexus Connection System of Imperial Pools Incorporated.

Similar to the first apertures 20, the second apertures 22 may be sized and positioned to correspond to fastener apertures (not shown) in the sides of adjacent wall panels 12. In some embodiments, the second apertures 22 may be configured for use with differing fasteners than those used with the first apertures 20. The wall panel insert 14 and the adjacent wall panels 12 may be coupled together with fasteners extending through or otherwise operably coupled with the second apertures 22 of the wall panels insert 14 and the corresponding apertures in the wall panels 12.

The wall panel insert 14 may be coupled in the seam between adjacent wall panels 12 as the wall panels 12 are installed to form the pool. For example, a wall panel insert 14 may be coupled in a seam between adjacent wall panels 12 as the adjacent wall panels 12 are secured to each other in the normal course of constructing a pool. In some embodiments, one or more wall panel insert 12 may be inserted and/or coupled in a seam between adjacent wall panels 12 before a panel brace is secured to the wall panels 12, and potentially before a bond seam is poured or otherwise constructed. A wall panel insert 14 may be positioned in multiple seams, as shown in FIGS. 1 and 2. In the illustrated embodiment, as the area of the pool configured to house or contain the pool stairs (and therefore the pool stair form 10) is substantially the same shape and size at the seams on either side of the straight or planar wall panel 12, a wall panel insert 14 may be coupled in each of these seams. In this way, two substantially similar or identical stair form braces 26 may be utilized and coupled the wall panels inserts 14 in the illustrated exemplary pool star form 10, as explained further below. However, it is particularly noted that any number of wall panel inserts 14 and corresponding braces (e.g., the illustrated brace 26 of FIGS. 4A-B) may be utilized in a particular pool stair form embodiment, and may be dependent upon, or at least related to, the particular shape and/or size of the of the area or space of the pool formed by the wall panels 12 to house or otherwise contain the pool stairs (and therefore the pool stair form 10). In this way, the pool stair form 10 may be configured to suit a particular pool shape or design.

Figure 4B:
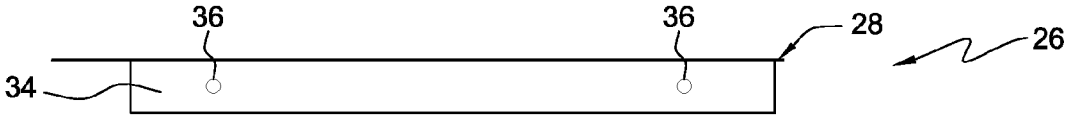
FIGS. 4A and 4B are top and side views, respectively, of an exemplary pool stair form brace of the first exemplary embodiment of the pool stair form of FIG. 1.
Figure 4A:
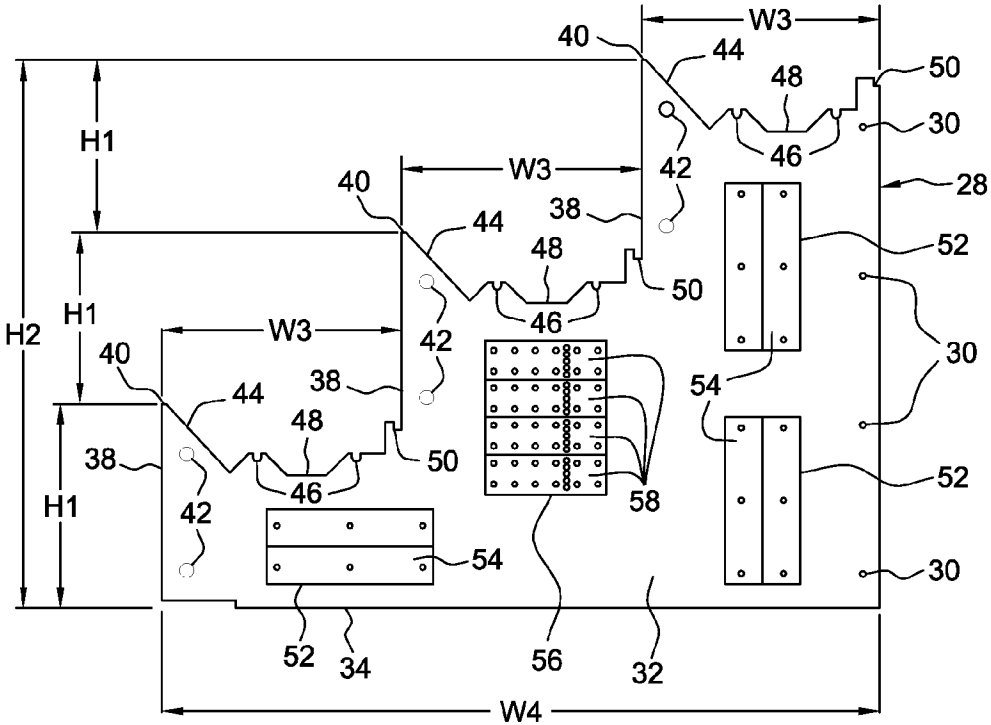

As shown in FIGS. 1, 2 and 4A-6, a stair form brace 26 may be configured to couple to the exemplary wall panel insert 14. As best shown in FIGS. 4A and 4B, the illustrated exemplary brace 26 may include an exemplary substantially planar, relatively thin main body portion 32 and an exemplary substantially planar, relatively thin foot portion 30 orientated at an angle with respect to the body portion 32. In the illustrated exemplary embodiments, the body portion 32 and foot portion 34 are oriented substantially normal to one another. As shown best in FIGS. 1, 2 and 4B, the foot portion 34 may be positioned and oriented to one side of the main body portion 32. In some embodiments, the brace 26 may be formed from sheet metal and the foot portion 30 oriented with respect to the body portion 32 by bending the foot portion 30 and/or body portion 32 with respect to one another. In reference to FIGS. 1 and 2, the foot portion 34 of the brace 26 may positioned on grade level within an un-finished pool and substantially aligned with the bottom of the wall panels 12 and/or a wall panel insert 14 positioned within a seam of the wall panels 12. In this way, the foot portion 34 of the brace 26 may at least partially support the brace 26 in an upright position such that the body portion 32 is substantially vertical and/or aligned with a wall panel insert 14. As shown in FIGS. 2 and 4B, the foot portion 34 of the brace 26 may include apertures or fixation points 36 configured to receive fasteners. The fasteners may act as anchors to secure the foot portion 34 of the brace 26 to the bottom of the unfinished pool. For example, pins (e.g., rebar pins) may be inserted through the apertures 36 of the foot portion 34 of the brace 26 and driven into the floor of the unfinished pool. As such, the brace 26 may be secured to the floor or bottom surface of the unfinished pool by way of the apertures 36 of the foot portion 34 thereof, and thus the step form 10 itself secured to the bottom surface of the unfinished pool (e.g., once the step form 10 is constructed).

As shown in FIGS. 1, 2 and 4A-6, the exemplary step form brace 26 includes an exemplary wall portion 28 along the rear side edge of the body portion 32 of the brace 26. The exemplary wall portion 28 of the exemplary brace 26 may include apertures or fixation points 30 that are arranged, sized and/or shaped to correspond to the apertures or fixation points 24 of the inner tab portion 17 of the of the lower portion 16 of the wall panel insert 14. The apertures 30 of the wall portion 28 of the brace 26 may be configured such that when the apertures 30 are substantially aligned with the apertures 24 of the inner tab portion 17 of the wall panel insert 14 (and potentially utilized to couple the brace 26 and wall panel insert 14), the foot portion 34 of the brace 26 is substantially aligned with the bottom surface or edge of the wall panels 12 and/or the wall panel insert 14. The apertures 30 of the wall portion 28 of the brace 26 may be aligned with the apertures 24 of the inner tab portion 17 of the wall panel insert 14 by positioned the wall portion 28 and inner tab portion 17 next to each other (e.g., side-by-side in abutment). Similarly, when the apertures 30 of the wall portion 28 of the brace 26 are substantially aligned with the apertures 24 of the inner tab portion 17 of the wall panel insert 14 (and potentially utilized to couple the brace 26 and wall panel insert 14 (e.g., with fasteners)), the rear side edge of the body portion 32 of the brace 26 may be substantially aligned with and/or in abutment with the wall panel 12 or the seam between adjacent wall panels 12.

Fasteners may be used to operably couple the step form brace 26 with wall panel insert via the apertures 30, 24, respectively. As the wall panel insert 14 may be coupled to the wall panels 12 in a seam between adjacent wall panels 12, the step form brace 26 can be coupled to the wall panels 12 via the exposed inner tab portion 17 of the wall panel insert 14. In this way, the step form brace 26 can be coupled to the wall panel insert 14 (and thereby the wall panels 12) after the wall panel insert 14 and wall panels 12 are coupled and installed. It is noted that other fastening means besides fasteners and the apertures 30 of the wall portion 28 of the brace 26 and the apertures 24 of the tab portion 17 of the wall panel insert 14 may be used to operably couple the brace 26 and the wall panel insert 14. For example, the brace 26 and the wall panel insert 14 may be coupled with one or more clamp, glue, bond, snap fit, key, pin, any other fastening mechanism that forms its own passageway through the brace 26 and the wall panel insert 14, any other fastening mechanism that does not form a passageway through the brace 26 and the wall panel insert 14, or any combination thereof that does or does not utilize, at least in part, the apertures 30 of the wall portion 28 of the brace 26 and the apertures 24 of the tab portion 17 of the wall panel insert 14.

The step form brace 26 may be configured to pre-define or otherwise guide or dictate, at least in part, the formation or construction of the pool stairs via the step form 10. For example, the step form brace 26 may act as a template or jig to facilitate, at least in part, the formation of parts of the pool steps, such as the size, shape and/or location of the riser portion and/or the tread portion of each of the steps. As shown in FIG. 4A, the exemplary brace 26 may include a series of riser edges or surfaces 38 spaced a width W3 apart from one another. In some embodiments, the width W3 between the riser edges or surfaces 38 may be between about 7 inches and about 12 inches, and more particularly between about 9 inches and 11 inches. However, it is noted that the riser edges or surfaces 38 may include any spacing, and may be non-uniformly or unevenly spaced from one another. The width W3 between the riser edges or surfaces 38 may also vary and depend, or at least be related to, the desired or required number of steps formed in the pool and/or the total width of the stairs. Similarly, the width between the upper most riser edge or surface 38 may be spaced from the rear edge of the brace 62 the width W3 between the other riser edges or surfaces 38. In this way, as described further below, the riser edges or surfaces 38 may layout a uniform and predefined width W3 of the tread portions 86 of the stairs formed via the step form 10 and filling material 88 as shown in FIG. 6.

In some exemplary pool stair form 10 embodiments (such as embodiments configured to form stairs against radiused or arcuate wall panels 12), the width W3 between the lower riser edges or surfaces 38 (or the lower treads 86) is about 15 and ⅜ inches and the width W3 between the upper most riser edge or surface 38 and an adjacent pool wall panel 12 (when coupled thereto) (or the upper most tread 86) is about 17 and ½ inches. In some other exemplary pool stair form 10 embodiments (such as embodiments configured to form stairs against at least one straight or planar wall panel 12), the width W3 between the lower riser edges or surfaces 38 (or the lower treads 86) is about 14 and ½ inches and the width W3 between the upper most riser edge or surface 38 and the top surface of an adjacent pool wall panel 12 (when coupled thereto) (or the upper most tread 86) is also about 14 and ½ inches.

The riser edges or surfaces 38 of the brace 26 may be substantially linear or planar and be oriented substantially perpendicular to the foot portion 34 and substantially parallel to the edge of the wall portion 28. In such an arrangement, if the wall panels 12 are installed substantially vertically and the grade on which the foot portion 34 of the brace 26 is rested upon is substantially horizontal, the riser edges or surfaces 38 of the installed brace 26 will be substantially vertical and substantially perpendicular to grade.

The riser edges or surfaces 38 may extend upwardly to a top edge, surface or point 40, as shown in FIG. 4A. In some embodiments, the riser edges or surfaces 38 may be substantially parallel to each other. The top edge 40 of the riser edges or surfaces 38 may define the upper most point of the riser edges or surfaces 38. The top edge 40 of each of the riser edges or surfaces 38 of the brace 26 may be evenly spaced in the height direction a height H1. Similarly, the height H3 between the top edge 40 of upper most riser edge or surface 38 of the brace 26 and the top of the adjacent wall panel 12 may be equal the height H1 between the other top edges 40. In some embodiments, however, the height H3 is not equal to the eight H1 (i.e., the top step is higher or lower than the other steps). In this way, as described further below, the top edge 40 of the riser edges or surfaces 38 may layout a uniform and/or predefined position or height of the riser portions 86 of the stairs formed via the step form 10 and filling material 88 as shown in FIG. 6.

In some exemplary pool stair form 10 embodiments (such as embodiments configured to form stairs against radiused or arcuate wall panels 12 or configured to form stairs against at least one straight or planar wall panel 12), the height H1 between the top surface 40 of the lowest riser edge or surface 38 (and/or the top surface 68 of the riser form 60 coupled thereto) and the grade of the pool floor or bottom surface of the pool wall panels 12 is about 12 and ⅜ inches, the height H3 between the top surface 40 of the upper most riser edge or surface 38 and the top surface of an adjacent pool wall panel 12 (when coupled thereto) is about 8 and ⅞ inches, and the height H1 between the top surface 40 of the medial riser edges or surfaces 38 (and/or the top surfaces 68 of the riser forms 60 coupled thereto) is about 10 and ⅜ inches.

In the illustrated embodiment, the top edge 40 of the riser edges or surfaces 38 of the brace 26 may be spaced in the height direction a distance H1/H3 of between about 4 inches to 12 inches, and more particularly between about 6 inches and 9 inches, and even more particularly about 7 inches to about 8 inches (and the riser portions of the stairs formed via the step form 10 and filling material 88 may be about 8 inches). However, it is noted that the top edge 40 of the riser edges or surfaces 38 may include any spacing, and may be non-uniformly or unevenly spaced from one another. The height H1/H3 between the top edge 40 of the riser edges or surfaces 38 may also vary and depend, or at least be related to, the desired or required number of steps formed in the pool and/or the depth of the pool.

In some embodiments, the brace 26 may include at least one aperture or fixation point 42 adjacent each riser edge or surface 38, as shown in FIG. 4A. The at least one apertures 42 adjacent the riser edges or surfaces 38 may be evenly spaced in the height and width directions with respect to one another. In the illustrated embodiment, the at least one apertures 42 adjacent the riser edges or surfaces 38 may be spaced from one another the height distance H1 and width distance W3 between the top edges 40 of the riser edges or surfaces 38. For example, each of the at least one apertures 42 may be positioned in a substantially similar position (and orientation when multiple apertures 42 are included) with respect to their corresponding riser edge or surface 38. However, it is noted that one or more aperture 42 adjacent the riser edges or surfaces 38 of the brace 26 may include any spacing, and may be non-uniformly or unevenly spaced from one another. The spacing between the one or more aperture 42 adjacent the riser edges or surfaces 38 may also vary and depend, or at least be related to, the desired or required number of steps formed in the pool and/or the depth of the pool.

The brace 26 may include an angled surface 44 extending from each top edge 40 of the riser edges or surfaces 38, as shown in FIG. 4A. Each angled surface 44 may extend from the top edge 40 of the riser edges or surfaces 38 in a downward direction (towards the foot portion 34) and towards the wall portion 28. Adjacent each angled surface 44 of the brace 26, the brace 26 may include a pair of reinforcement support members 46 and a channel surface 48 therebetween, as shown in FIGS. 4A and 6. The reinforcement support members 46 may be configured to support reinforcement material in a position below (e.g., in a direction towards the foot portion 34) the top edge 40 of the riser edges or surfaces 38. Similarly, the channel surface 48 extending between the reinforcement support members 46 may be positioned below the reinforcement support members 46. In such an arrangement, as shown in the illustrated embodiments of FIGS. 1, 4A and 6, the reinforcement support members 46 may positioned below (e.g., in a direction towards the foot portion 34) the top edge 40 of the riser edges or surfaces 38 and above the channel surface 48. In this way, reinforcement material supported by the reinforcement support members 46 may be positioned below the tread portion 86 of each step (as explained further below) and include filling material 88 (e.g., the material that forms the steps) between the reinforcement material and the brace 26 (i.e., between the reinforcement material and the channel surface 48), as shown in FIG. 6.

In the illustrated exemplary embodiment, the reinforcement support members 46 include arcuate or semicircular surfaces configured to support the side members of a reinforcement lattice 80 extending the length of the stairs formed between the wall panels 12. The reinforcement lattice 80 may add strength to the stairs formed by the step form 10. For example, if the stairs are formed from filling material 88 such as concrete or a similar material and the step form 10, the reinforcement lattice 80 may be encapsulated in the formed stairs and may add tensile strength to the stairs. In some embodiments, the reinforcement lattice 80 may be a metal reinforcement lattice 80.

Adjacent each reinforcement support member 46 positioned proximate the wall portion 28, the brace 26 may include a liner support channel, space, member, surface, edge, feature or the like 50. The liner support feature 50 may be any configuration effective in supporting a liner support member or mechanism in a particular position with respect to the other aspects or components of the brace 10 and the step form 10. In the illustrated exemplary embodiment, the brace 10 includes a liner support channel 50 positioned or constructed such that is adjacent the next riser edge or surface 38 towards the wall portion 28 (and thereby towards the wall panels 10 when the step form 10 installed), as shown in FIGS. 4A and 6. As also shown in FIGS. 4A and 6, the liner support channel 50 may be positioned below the top edge 40 of the riser edges or surfaces 38 but above the reinforcement support members 46. The configuration of the liner support channel 50 may depend, or at least be related to, the particular liner support member being used in the step form 10. In the illustrated exemplary embodiment shown in FIG. 4A, each liner support channel 50 includes a channel, space or gap formed between a portion of the brace 26 and the adjacent riser edge or surface 38. The upper most support channel 50 formed immediately adjacent the edge of the wall portion 28 of the brace 26, however, may be formed between a portion of the brace 26 and the wall panel 12 and upper portion 18 of the adjacent wall panel and/or wall insert 14 (as there is no adjacent riser edge or surface 38).

As shown in FIGS. 1 and 6, the illustrated exemplary assembled and installed (and eventually filled) step form 10 includes liner support members 82 positioned in each support channel 50 of the brace 26. The exemplary liner support members 82 are effective in supporting a pool liner to the formed pool stairs. As the exemplary support channels 50, and thereby the corresponding liner support members 82, are positioned substantially at the intersection of the riser and treads of the stairs formed from the step form 10, the pool liner 84 used to line or cover the formed pool and pool stairs is secured to the stairs at the intersection of the riser and treads of the stairs. As shown in FIG. 6, the liner support members 82 may be positioned within a corresponding support channel 50 and fastened to the adjacent riser form 60 (or the wall panel 12 for the upper most liner support member 82), as explained further below. The liner support members 82 may be elongate, relatively deformable or flexible strip-like members that include an arm or L-shaped member extending upwardly from the support channel 50 and towards, but spaced from, the riser edge or surface 38 when installed (or the adjacent wall panel 12 for the upper most liner support member 82). The arm or member of the liner support members 82 thereby may form a channel, gap, clearance, space or the like between each support member and the adjacent riser edge or surface 38 of the brace 26 and/or a riser form 60 coupled thereto (or the wall panel 12 for the upper most liner support member 82). In this way, the liner 84 may include a bead, coping, tab portion or otherwise be tucked or positioned between the arm or member of the liner support members 82 and a riser edge or surface 38 of the brace 26 and/or a riser form 60 (or the wall panel 12 for the upper most liner support member 82) as shown in FIG. 6.

As also shown in FIG. 6, each channel 50 and/or liner support member 82 may be configured such that the top or upper most surface of the arm or member of the liner support members 82 is substantially parallel with the top edge 40 of the adjacent riser edge or surface 38 in a direction extending away from the wall portion 28 and the wall panels 12 (i.e., down the formed stairs), as shown by the dashed line 86 in FIG. 6. As explained further below, in such an arrangement the top edges 40 of the riser edges or surfaces 38 and/or the top edges 68 of the riser forms 60 coupled to the brace 26 and aligned therewith and the top edge or surface of the installed liner support members 82 (the top edge of the arm) may be used as a guide or template to form the tread portions 86 of the stairs formed by the stair form 10 and filling material 88. For example, if the filling material 88 partially forming the stairs is concrete or other similar material, the assembled and installed stair form 10 may be filled with aggregate and concrete and a float or other substantially linear or planar member may be positioned against the top edges 40 of the riser edges or surfaces 38 of the braces 26 and/or the top edges 68 of the riser forms 60 coupled to the braces 26 and the top edge or surface of the installed liner support members 82 and dragged or pushed across the length of the stairs between the panel walls 12. In this way, the assembled and installed stair form 10 provides for easy and accurate forming of substantially flat, level and pre-arranged, pre-positioned or pre-designed stair treads 86. The dashed line 86 in FIG. 6 thereby represents the tread of stairs formed by the stair form 10 in such a manner. As explained above and also shown in FIG. 6, a liner 84 may be applied over the formed stairs, including the treads 86.

Figure 3A:
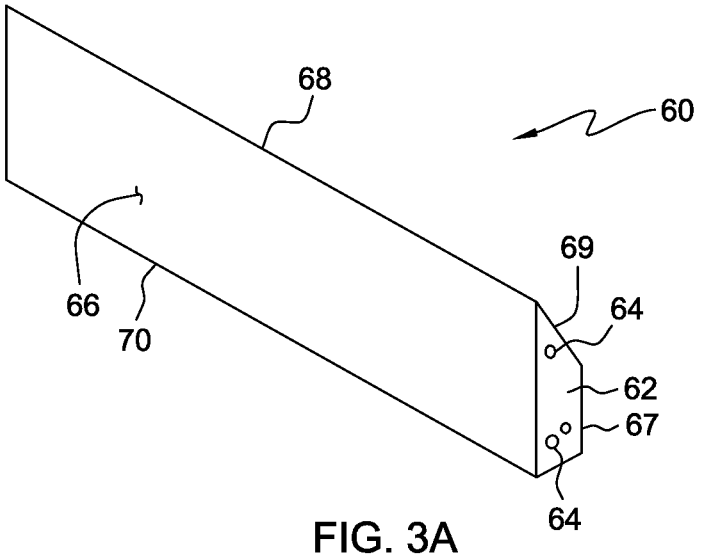
Figure 3B:
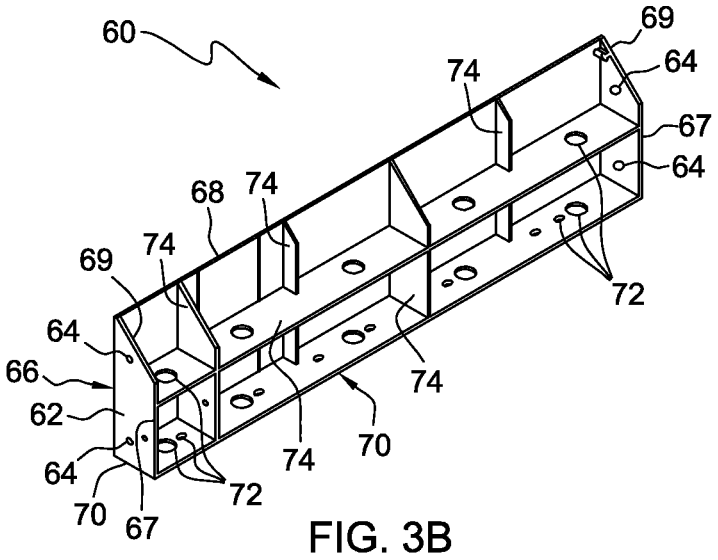

The riser edges or surfaces 38 of the braces 26 may guide or dictate the number, location, relative position, orientation, size and/or any other configuration variable of the riser 66 and/or tread 86 portions of the steps formed by the step form 10. For example, as explained further below the step form 10 may utilize a riser form 60 coupled to the riser edges or surfaces 38 of the braces 26, as shown in FIGS. 3A and 3B, to form the riser portions of the stairs (see FIGS. 1, 2 and 6). Thereby, the braces 26 may act as a stair stringer (at least before the filling material 88 is added). In such embodiments, the riser edges or surfaces 38 may be used, at least in part, to align or situate a riser form 60 in a particular location with one or more braces 26. For example, each side of a riser form 60 may be aligned with the riser edge or surface 38 (and/or the top edge 40 thereof) of a brace 26, as shown in FIGS. 1 and 2, and coupled thereat. Stated differently, a riser form 60 may be positioned and coupled between two braces 26, and aligned (such as a front face 66 thereof aligned) with the riser edge or surface 38 (and/or the top edge 40) thereof. Similarly, a riser form 60 may be positioned and coupled between a brace 26 and a wall panel 12, and aligned with the riser edge or surface 38 (and/or the top edge 40 thereof) of the brace 26 as also shown in FIGS. 1 and 2. The end of the riser form 60 adjacent a wall panel 12 (opposing the end of the riser form 60 coupled to the brace 26) may be trimmed or otherwise formed into a length such that it abuts or is substantially close to the adjacent wall panel 12, and secured thereto (e.g., via a support member and fasteners) such that the riser form 60 is aligned and parallel to an adjacent riser form 60 (i.e., the adjacent riser form 60 coupled on the other side of the brace 26). In such an embodiment, the riser forms 60 may be coupled to the braces 26 in substantially identical positions and orientations with the riser form 60 corresponding to each step. If the wall panel or panels 10 to which the braces 26 are coupled, via wall inserts 14 for example, is/are substantially planar and vertical, the riser forms 60 may also form a substantially planar and vertical riser portion 66 of the formed stairs (as the riser edge or surface 38 may be linear and oriented substantially vertical, as explained below). This process may be repeated for the riser forms 60 corresponding to each side of each brace 26 and each riser edge or surface 38 of the step form 10 to form the riser portions 66 of the steps. In this way, the riser forms 60 and riser edges or surfaces 38 (and/or the top edges 40) of each brace 26 of the step form 10 may be utilized to facilitate quick and accurate assembly of the step form 10 in the field (at the pool site), and thereby accurately form stairs in a preconfigured arrangement, configuration or design.

Similar to the riser edges or surfaces 38, the at least one apertures or fixation points 42 adjacent the riser edges or surfaces 38 may guide or dictate the number, location, relative position, orientation, size and/or any other configuration variable of the riser 86 and/or tread 66 portions of the steps formed by the step form 10. For example, as explained further below the step form 10 may utilize a riser form 60 coupled to the braces 26 via the at least one apertures 42, as shown in FIGS. 3A and 3B, to form the riser portions 66 of the stairs (see FIGS. 1, 2 and 6). Thereby, the braces 26 may act as a stair stringer (at least before the filling material 88 is added). In such embodiments, the at least one apertures 42 adjacent the riser edges or surfaces 38 of the brace 26 may be used, at least in part, to align or situate a riser form 60 in a particular location with one or more braces 26. For example, each side 62 of the riser form 60 may include at least one apertures or fixation point 64, and the at least one aperture 64 of the riser may be aligned with the at least one aperture 42 of a brace 26, as shown in FIGS. 1 and 2. Stated differently, a riser form 60 may be positioned and coupled between two braces 26, and the at least one apertures 64 thereof may be aligned with the at least one apertures 42 of the braces 26. In such an embodiment, the riser forms 60 corresponding to each step may be coupled to the braces 26 in substantially identical positions and orientations. In this way, the at least one apertures 64 of the riser forms 60 and the at least one apertures 42 of each brace 26 may be utilized to facilitate quick and accurate assembly of the step form 10 in the field (at the pool site), and thereby accurately form stairs in a preconfigured arrangement, configuration or design.

An exemplary riser form 60 is illustrated in FIGS. 3A and 3B. As shown in FIGS. 3A and 3B, an exemplary riser form 60 may include a substantially planar front face 66 that ultimately may form the riser portion of the stairs formed by the step form 10 and filling material 88. The front face 66 of the riser from 60 may extend from a top edge or surface 68 to a bottom edge or surface 70 and between side edges or surfaces 62, as shown in FIGS. 3A and 3B. The front face 66 of the riser form 60 may form the riser portion of the stairs formed by the exemplary pool form 10.

In some embodiments, the side surfaces 62 of the riser form 60 may be substantially planar and substantially parallel to each other. In some exemplary embodiments the side surfaces 62 of the riser form 60 may be defined by the edge of the front face 66, a back edge or surface 67 spaced in the width direction of the step form 10 from the front face 66, the edge of the bottom surface 70 extending between the front face 66 and back edge 67 and a top edge or surface 69 also extending between the front face 66 and back edge 67, as shown in FIG. 3B. In some such embodiments, the bottom surface 70 may be substantially perpendicular to the front face 66 and back edge 67, and the back edge or surface 67 may be shorter than the front face 66, as shown in FIGS. 3A and 3B. As also shown in FIGS. 3A and 3B, in such an embodiment the top edge or surface 69 may be angled with respect to the front face 66 and back edge or surface 67 such that the top edge or surface 69 of the side surfaces 62 extends downwardly from the top edge or surface 68 of the front face 66 to the top of the back edge or surface 66.

The side surfaces 62 of the riser form 60 may include at least one aperture 64 or fixation point, as shown in FIGS. 3A and 3B and discussed above. The at least one aperture 64 in the side surfaces 62 of the riser form 60 may be preformed when the riser form 60 itself is formed, or may be formed after the riser form 60 is formed. For example, a template or jig may be used to facilitate the formation of the at least one apertures 64 of the side surfaces 62 of the riser forms 60 in their particular locations.

The riser form 60 may also include one or more rib member 74 positioned along a length of the riser form 60 between the side surfaces 62 thereof, as shown in FIG. 3B. In some embodiments, at least one of the rib members 74 may be shaped substantially similar to the side surfaces 62 of the riser form 60. In some embodiments, the riser form 60 may include several rib members 74 extending from the interior side of the front face 66. For example, the illustrated exemplary riser form 60 shown in FIG. 3B includes several vertical ribs 74 and a horizontal rib 74 positioned in a medial portion of the height of the riser form 60 extending from the interior of the front face 66. However, the at least one rib member 74 may be configured in any manner effective in providing stability to the riser form 60. It is noted that a riser form 60 may be formed without at least one rib member 74, or a riser form may be trimmed or otherwise reduced in size such that one or more rib member 74 is removed from the riser form 60. For example, the riser form 60 may be formed from one of the wall panels 12. In such embodiments, for example, the riser form 60 may be cut or otherwise removed from a wall panel, such as a deformable or pliable polymer wall panel 12. Such an exemplary riser form 60 may thereby include a length equal to the height of the particular host wall panel 12. To fit between a brace 26 and an adjacent wall panel 12 when the step form 10 is assembled and installed as shown in FIGS. 1 and 2, for example, the riser form 60 may be cut or otherwise shortened (e.g., cut on site) such that it abuts or substantially extends between the particular brace 26 and wall panel 12, as shown in FIGS. 1 and 2. As also shown in FIG. 2, a riser form 60 may be cut or otherwise shortened such that it includes an angled or curved side edge or surface 62 that at least partially corresponds to the shape or orientation of the wall panel 12 to which is abuts. During such a shortening process, one or more rib member 74 may be eliminated, at least partially.

As also shown in FIG. 3B, the at least one rib member 74 and/or the bottom surface 70 of the riser form 60 may include at least one apertures or fixation point 72 therethrough. The at least one aperture 72 of the at least one rib member 74 and/or the bottom surface 70 of the riser form 60 may allow a support member, such as a rigid pin (e.g., a rebar pin), to be inserted through the riser form 60 and, potentially, into the ground or surface below the step form 10 when the step form is assembled and being installed. In such a manner, support members may be utilized to couple the riser forms 60 included in the step form 10 with the ground or surface below the step form 10. Such support members may be effective in supporting the step form 10 and/or stairs formed via the step form 10 and filling material 88 to the ground or surface below the step form 10 and filling material 88 (i.e., the formed pool stairs).

As shown in FIG. 4A, an exemplary brace 26 may include one or more removable clip or brace formed in the main body portion 32 of the brace 26 such that removal of the one or more removable clip or brace forms an aperture in the main body portion 32 of the brace 26. For example, in the illustrated exemplary embodiment shown in FIG. 4A the main body portion 32 of the brace 26 includes removable wall clips 54 and blocking angles 58 that form first and second voids 52, 56, respectively, in the main body portion 32 of the brace 26 when removed therefrom. In some embodiments, the wall clips 54 and blocking angles 58 may be substantially pre-cut or separated from the brace 26 such that a relatively small amount of material couples the wall clips 54 and blocking angles 58 to the brace 26. For example, the wall clips 54 and blocking angles 58 may be configured such that they can be removed from the brace 26 by manually twisting, pushing or pulling the wall clips 54 and blocking angles 58 with respect to the brace 26. In some embodiments, the wall clips 54 and blocking angles 58 may be partially stamped out from the brace 26. In such a manner, the wall clips 54 and blocking angles 58 may be manually removed during assembly and installation of the step form 10 in the field.

Once removed from the brace 26, the wall clips 54 may be utilized to support the ends of the step forms 60 to the wall panels 12, as shown in FIG. 2. For example, one portion of the wall clips 54 may be fastened to the end of the step forms 60 (e.g., to a horizontal rib member 74) with a fastener and another portion of the wall clips 54 may be fastened to the wall panels 12. As the step form 10 is utilized to form stairs such as by filling the interior of the step form 10 with filling material 88, the wall clips 54 may become an integral and permanent part of the formed stairs. Thereby, the wall clips 54 may secure the step forms 60 to the wall panels 12 both before and after stairs are formed via the pool stair form 10 and filling material 88. In a similar manner, once removed from the brace 26 the blocking angles 58 may be utilized to further support the ends of the step forms 60 to the wall panels 12, as shown in FIG. 2. The blocking angles 58 may be fastened to the front face 66 of the riser form 60 and the adjacent wall panel 12. In such an arrangement, the blocking angles 58 may be particularly effective in securing the step forms 60 in the width direction. For example, in such an arrangement the blocking angles 58 may be effective in preventing the step forms 60 from deforming or otherwise traveling into the interior of the pool when the step form 10 is assembled, installed and filled with filling material 88 to form the pool stairs (e.g., form the tread portions 86).

As explained above and shown in FIG. 6, removal of the wall clips 54 and blocking angles 58 from the braces 26 may result in first and second voids 52, 56, respectively, in the main body portion 32 of the brace 26. In some such embodiments, when the pool step form 10 is assembled, installed and filled with filling or forming material 88 (e.g., aggregate and/or concrete or the like) forming, in part, the stairs (along with the pool stair form 10 itself), the filling or forming material 88 may flow into and substantially fill the first and second voids 52, 56, as shown in the cross-sectional view of FIG. 6. In such an arrangement or configuration, the first and second voids 52, 56 may be effective in substantially integrating the braces 26 (and any components coupled thereto) with the filling or forming material 88. In this way, the pool stair form and the filing material 88 (once cured, for example) may form an interconnected, unitary or integral structure (i.e., an integral pool stair structure). Similarly, as also shown in FIG. 6 the filling or forming material 88 may flow and substantially fill the area within the back side of the step forms 60 (the side opposing the front face 66), such as areas about the one or more rib member 74. Still further, the filling or forming material 88 may flow into and substantially fill the area extending between the top edges 40 of the riser edges or surfaces 38 and/or the top edges 68 of the riser forms 60 and the top of the arm of the liner support members 82. For example, the filling or forming material 88 may flow into and substantially fill the area about the channel surface 48, reinforcement support members 46 and reinforcement lattice 80 and up to a plane defined by the top edges 40 of the riser edges or surfaces 38 and/or the top edges 68 of the riser forms 60 and the top of the arm of the liner support members 82. In some embodiments, the filling or forming material 88 may be screened or floated with a linear or planar member contacting the top edges 40 of the riser edges or surfaces 38 and/or the top edges 68 of the riser forms 60 and the top of the arm of the liner support members 82. In this way, the edges 40 of the riser edges or surfaces 38 and/or the top edges 68 of the riser forms 60 and the top of the arm of the liner support members 82 may be used to form the filling or forming material 88 into stair treads 86, and the front face 66 of the riser forms 60 may form stair risers. A liner member 84 may be applied over the stair treads 86 (e.g., cured filling material 88) and stair risers or front faces 66 and secured thereto via the liner support members 82. The liner member 84 may also be applied over the exposed portions of the wall panels 12 adjacent or abutting the pool stair form 10. Thereby, the pool stair form 10 may be used to form pool stairs within a pool formed via pool wall panels 12.

As described above, the exemplary pool stair form 10 shown in FIGS. 1-6 may be used in combination with filling material 88 to form pool stairs within a pool formed via pool wall panels 12. The assembly and installation process of the pool stair form 10 may begin with removal of the wall clips 54 and blocking angles 58 from the braces 26, thereby forming the first and second voids 52, 56 therein. Depending upon the arrangement of the particular pool in which the pool stairs are formed, one or more wall panel insert 14 may be coupled in a seam between adjacent wall panels 12. The one or more wall panel insert 14 may be coupled between adjacent wall panels 12 in the same manner the wall panels 12 themselves are coupled to each other. In the illustrated exemplary embodiment, two wall panel inserts 14 are used and installed on either side of a planar or straight wall panel 12.

One or more brace 26 and riser form 60 may be coupled to each other. The riser forms 60 may be obtained by removing the riser forms 60 from a wall panel 12, or may be pre-formed or otherwise provided. In the illustrated exemplary embodiment bottom, middle and top riser forms 60 may be coupled between two braces 26. It is noted, however, that the braces 26 may be configured to utilize less than, or more than, three riser forms (i.e., may be configured to form more or less than three stairs). More particularly, bottom, middle and top riser forms 60 may be positioned between and aligned with one or more of the riser edges or surfaces 38, top edges 68 and apertures 68 of the pair of riser forms 60. For example, at least one of the front face 66 of each riser form 60 may be aligned with the corresponding riser edges or surfaces 38 of the braces 26 and coupled thereat, the top edge 68 of the front face 66 of each riser form 60 may be aligned with the corresponding top edge 40 of the riser edges or surfaces 38 of the braces 26 and coupled thereat, and the at least one aperture 64 of the side faces 62 of each riser form 60 may be aligned with the corresponding apertures 42 of the braces 26 and coupled thereat. In this way, each riser form 60 (bottom, middle and top) may be coupled to the braces 26 (e.g., via fasteners with the apertures 64 of the riser forms 60 and the apertures 42 of the braces 26) in a predefined position and orientation in a clear and accurate way.

Additionally riser forms 60 may be coupled to the riser forms 60 on the exposed sides of the riser forms 60 (the sides opposing the previously installed riser forms 60). In this way, the riser forms 60 may be sandwiched between two riser forms 60. For example, in the illustrated exemplary embodiment right and left bottom, middle and top riser forms 60 may be coupled to the exposed sides of the pair of braces 26. Due to the shape of the area of the pool formed by the pool wall panels 12 that may house or contain the stairs (and therefore the pool stair form 10), the right and left bottom, middle and top riser forms 60 may be differing lengths. As shown in FIGS. 1 and 2, the shape of the pool formed by the pool wall panels 12 may dictate that the right and left bottom riser forms 60 may be the relatively long right and left riser forms 60, the right and left top riser forms 60 may be the relatively short right and left riser forms 60, and the right and left middle riser forms 60 may be shorter than the bottom right and left top riser forms 60 but longer than the right and left top riser forms 60. The right and left bottom, middle and top riser forms 60 (of differing lengths) may be pre-cut or otherwise provided in the appropriate or correct lengths, or the right and left bottom, middle and top riser forms 60 may be formed on-site by cutting or otherwise shortening riser forms 60 (such as the riser forms 60 that are configured to be coupled between the pair of braces 26).

Once the right and left bottom, middle and top riser forms 60 are aligned and coupled to the exposed side of the pair of braces 26 (e.g., via fasteners with the apertures 64 of the riser forms 60 and the apertures 42 of the braces 26), the wall clips 54 may be fastened to the free ends of the right and left bottom, middle and top riser forms 60 (the ends of the riser forms 60 opposing the sides 62 coupled to the braces 26). The assembled pair of braces 26 and riser forms 60 (forming the risers 66 of three stairs) may then be fastened to the pair of wall inserts 14 coupled in the seam of the wall panels 12. For example, the wall portion 28 of the braces 26 may be coupled to the inner tab portion 17 of the lower portion 16 of the wall panel inserts 14 (e.g. via fasteners operably coupling the apertures or fixation points 24 of the wall panel inserts and the apertures or fixation points 30 of the braces 26). The free end or non-fastened portion of the wall clips 54 may then be fastened to the wall panels 12. In such an arrangement the partially assembled step form 10 may be considered coupled to the wall panels 12.

Rigid support members may be driven through the apertures or fixation points 72 of each step form 60 and/or the apertures or fixation points 39 of the foot portion 34 of each brace 60 and into the ground or lower surface under the step form 10 once the step form 10 is coupled to the wall panels 12 (at least partially). Also, the blocking angles 58 may be fastened to the front face 66 of the step forms 60 and the wall panels 12. As noted above, the blocking angles 58 may be effective in preventing the left and right step forms 60 from disengaging from the wall panels 12 when the step form 10 is filled with filling or forming material 88. After the pool stairs are formed via the step form 10 and filling material 88, the blocking angles 58 may be removed. Further, reinforcement material may be applied to the front face 66 of the step forms 60. For example, metal bars or lumber may be fastened to the front face 66 of the step forms 60. Similar to the blocking angles 58, the reinforcement material applied to the front face 66 of the step forms 60 may be effective in stiffening the step forms 60 and preventing the step forms 60 from bowing or otherwise deforming into the interior of the pool when the step form 10 is filled with filling material 88.

Once the step form 10 is coupled to the wall panels 12 and the step forms 60 are reinforced, filling material 88 may be poured or otherwise transferred into the interior of the pool form 10 (e.g., between the wall panels 12 and the step forms 60). For example, a 2,500 psi concrete footer may be poured around all the stair braces 60, such as about a minimum of about 6 inches deep. Also, at this time a concrete footer around the perimeter of the wall panels 12 may be poured. The concrete or other filling material 88 may be allowed to cure after it is poured, such as allowed to cure for about 24 hours.

After an initial level of filling material 88 is applied within the interior of the step form 10 (e.g., concrete footer), an additional second level of filling material 88 may be applied within the step form 10. For example, backfill with stone or clean non-expansive earth may be transferred into the interior of the step form 10 and over the initial or first level of filling material 88 (e.g., a footer). The second level of filling material 88 may be compacted. The second level of filling material 88 may also be applied such that it allows for the application of a third level of filling material 88 that forms a minimum of about 5 and ½ inches thick tread 86. For example, the third level of filling material 88 may be concrete poured over the second filling level 88 such that treads 86 of at least about 5 and ½ inches thick may be formed between the top edges 40 of the riser edges or surfaces 38 and/or the top edges 68 of the riser forms 60 and the top of the arm of the liner support members 82. Also, the second layer of filling material 88 may be applied such that it does not extend above a cross-sectional rib member 74 of the step forms 60 (if provided). In such an embodiment, the treads 86 may be formed by floating the third layer of filling material 88 with a rigid member applied against the top edges 40 of the riser edges or surfaces 38 and/or the top edges 68 of the riser forms 60 and the top of the arm of the liner support members 82.

Before the treads 86 are formed between the top edges 40 of the riser edges or surfaces 38 and/or the top edges 68 of the riser forms 60 and the top of the arm of the liner support members 82, the reinforcement lattice 80 (e.g., wire tread reinforcement) may be positioned within the reinforcement support members 46 over the channel surface 48 of the braces 60, as shown in FIGS. 1 and 6. The reinforcement support members 46 may be tied or otherwise coupled to the braces 60. Also, before the treads 86 are formed (i.e., before the third layer of filling material 88 is applied) the liner support members 82 may be fastened (e.g., with screws) to the in the support channel 50, as shown in FIGS. 1 and 6. The liner support members 82 may be provided in predefined lengths (e.g., 8 foot lengths) and cut or joined with multiple pieces to form additional lengths based on the length of a particular stair. The gap or opening of the liner support members 82 between the arm thereof and the adjacent riser form 60 (bottom and middle liner support members 82) or wall panel 12 (top liner support members 82) may be sealed or covered with tape, filler material (e.g., a "liner lock") or the like to prevent the filling material 88 (e.g., concrete) from collecting, blocking or otherwise penetrating within the gap or opening of the liner support members 82.

Once the reinforcement lattice 80 and liner support members 82 are applied to the step form 10 and/or wall panels 12, the third layer of filling material 88 may be applied within the interior of the step form 10 and the step treads 86 formed, as explained above. As such, the reinforcement lattice 80 and liner support members 82 will be encapsulated by the third layer of filling material 88 (except for the gap or opening provided by the liner support members 82). Once the third layer of filling material 88 is cured and the treads 86 are formed, the liner 84 may be applied over the formed stairs and secured within the gap or opening provided by the liner support members 82 at the intersection of the treads 86 and risers 66 (a portion of the front face 66 of the riser forms 60).

Figure 7:
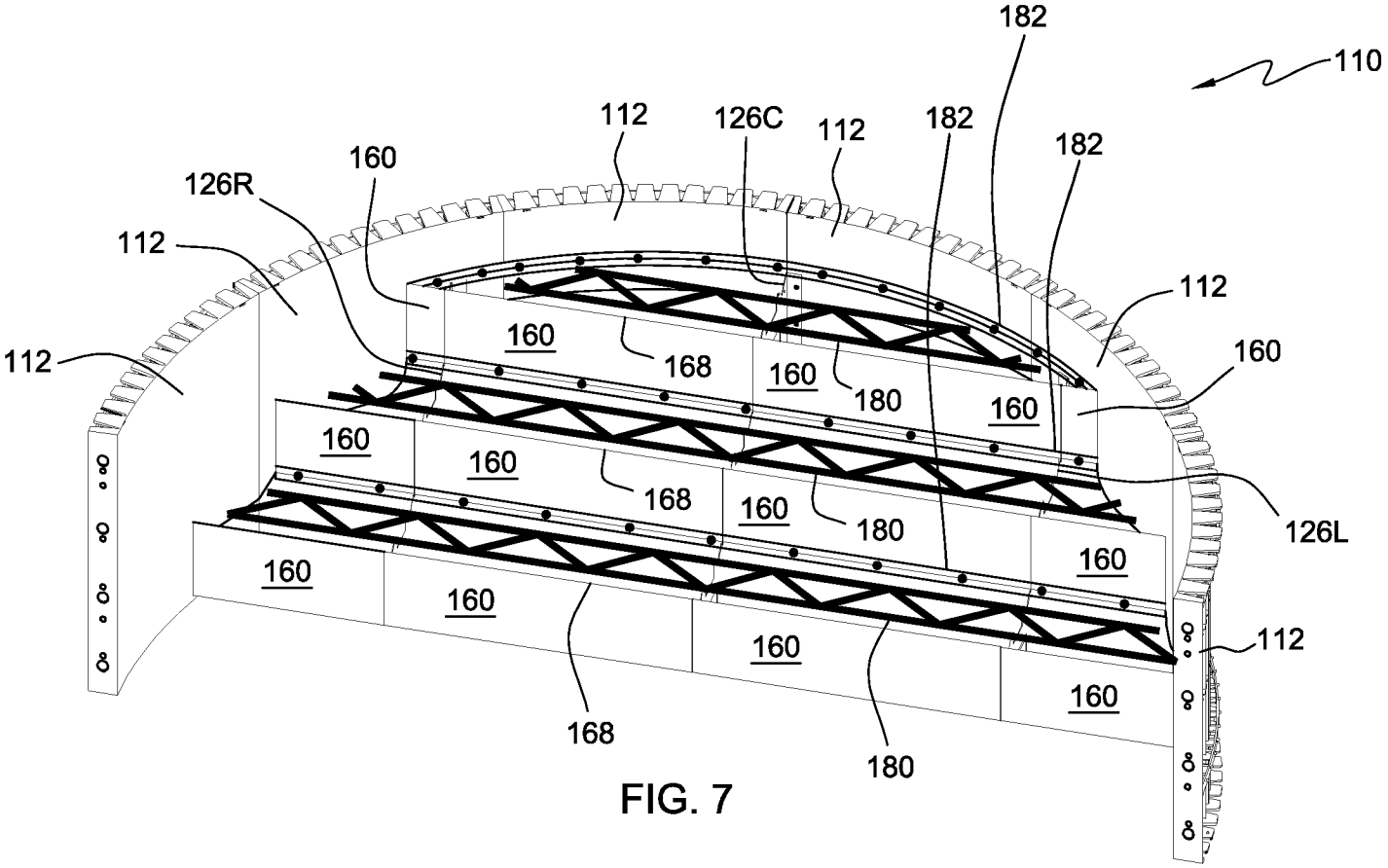
FIG. 7 is a perspective view of a second exemplary embodiment of a pool stair form.
Figure 8:
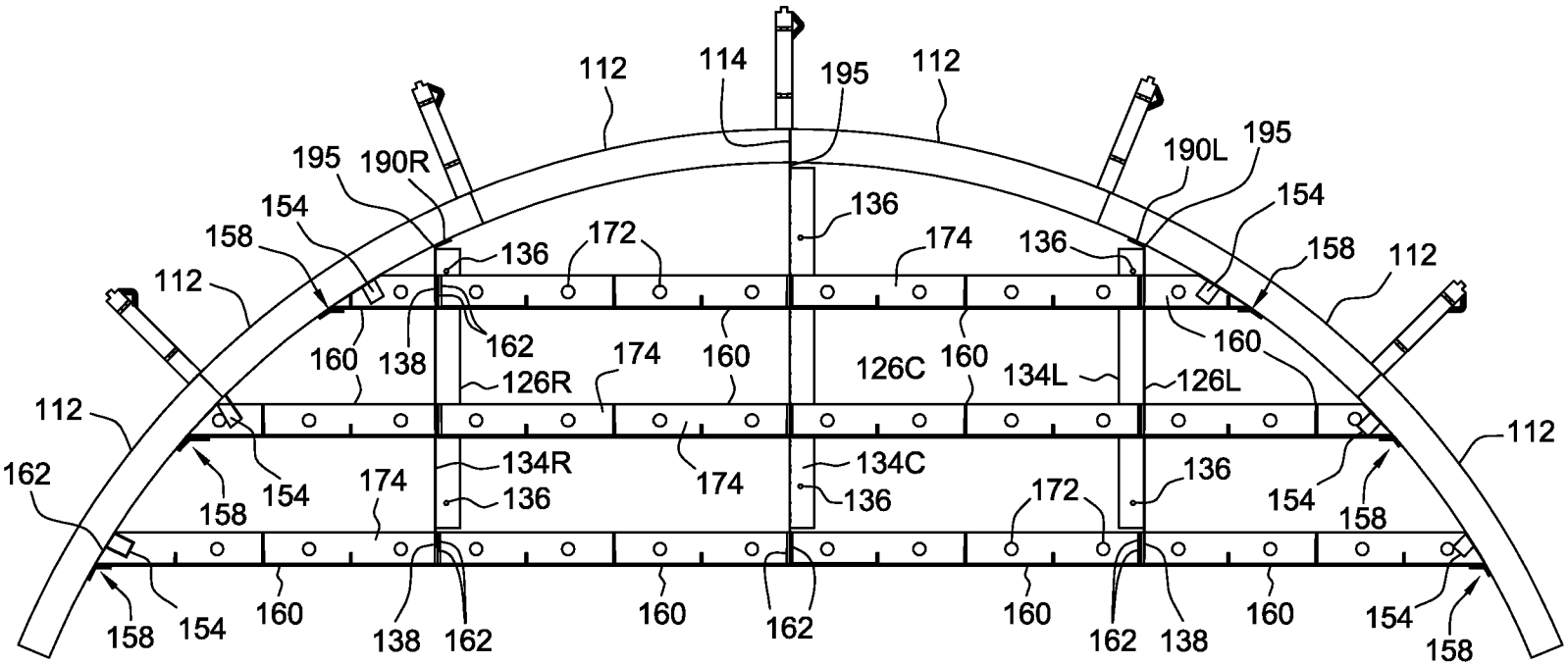
FIG. 8 is a top view of the second exemplary embodiment of the pool stair form of FIG. 7.
Figure 10:
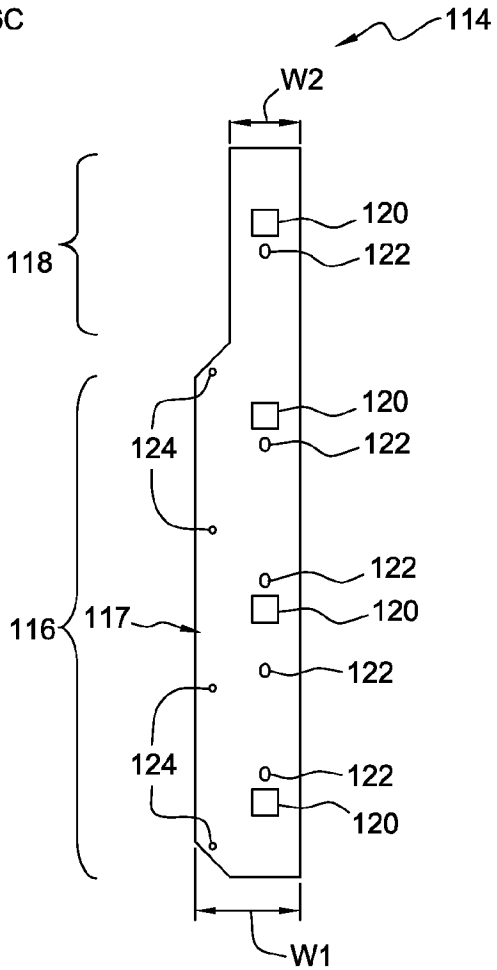
FIG. 10 is a side view of an exemplary pool wall insert of the second exemplary embodiment of the pool stair form of FIG. 7.
Figure 9A:
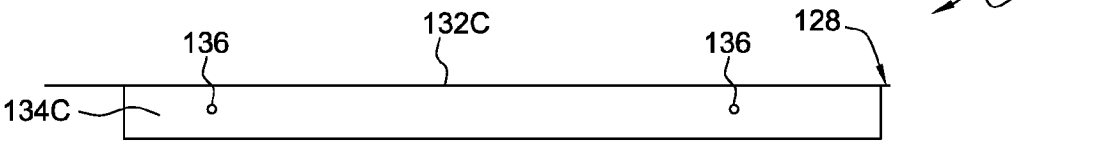
FIGS. 9A and 9B are top and side views, respectively, of an exemplary pool stair form center brace of the second exemplary embodiment of the pool stair form of FIG. 7.
Figure 9B:
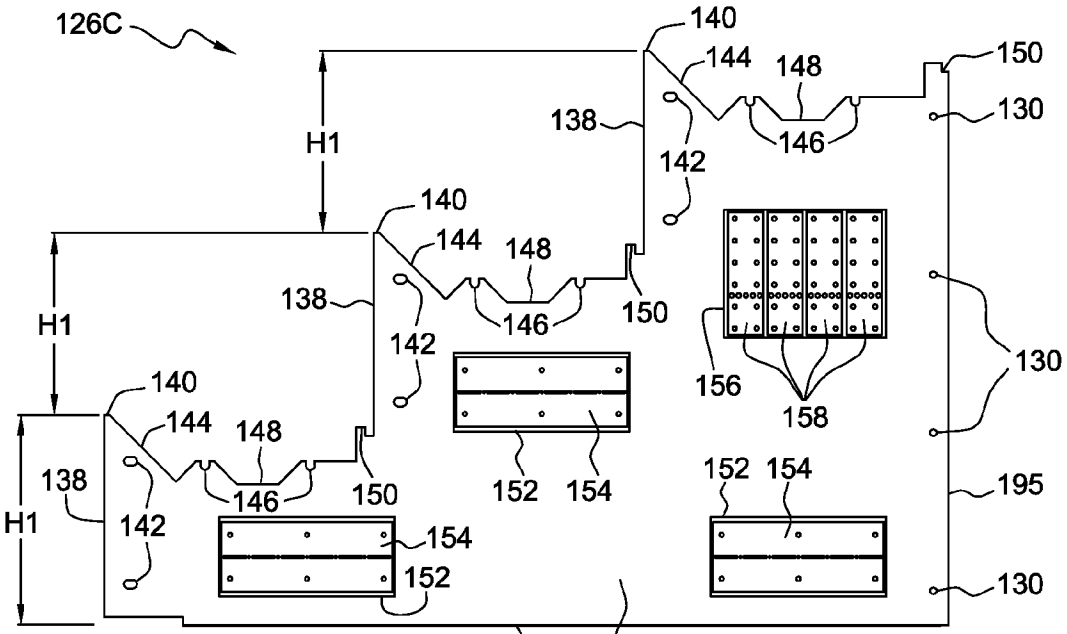

In FIGS. 7-14, another exemplary pool stair form embodying a second embodiment is indicated generally by the reference numeral 110. The exemplary pool stair form 110 is substantially similar to exemplary pool stair form 10 described above with reference to FIGS. 1-6, and therefore like reference numerals preceded by the numeral "1" are used to indicate like elements. One difference between the exemplary pool stair form 10 and the exemplary pool stair form 100 is the application of the stair form 10 to form stairs in a straight segment or portion of a pool as compared to a curved or radiused segment or portion of a pool, respectively. As shown in FIGS. 7 and 8, the exemplary pool stair form 100 is configured to form pool stairs in a radiused pool (a portion of a pool with a radiused outer edge or outer wall panels 112).

As such, the exemplary pool stair form 100 includes an exemplary center brace 126C, and exemplary left 126L and right 126R braces that differ from the exemplary center brace 126C, as shown in FIGS. 8-9B and 12A-13. In particular, to account for the curvature of the pool wall panels 112, the exemplary center brace is wider than the left and right braces 126L, 126R. The braces 126C, 126L, 126R are configured such that when they are coupled to the wall panels 112, at least the apertures or fixation points 142 of the braces 126C, 126L, 126R are aligned across the length of the pool and centered about the center brace 126C (i.e., the riser edge or surface 138 are aligned such that the front faces 166 of the riser forms 160 coupled thereto are perpendicular to the braces 126C, 126L, 126R and form a straight surface across the pool). In this manner, at least the apertures or fixation points 142 of braces 126C, 126L, 126R may be utilized to secure the riser forms 160 in a predetermined position and orientation to form accurate, level and uniform stair risers 166 and treads 186.

Figure 11:
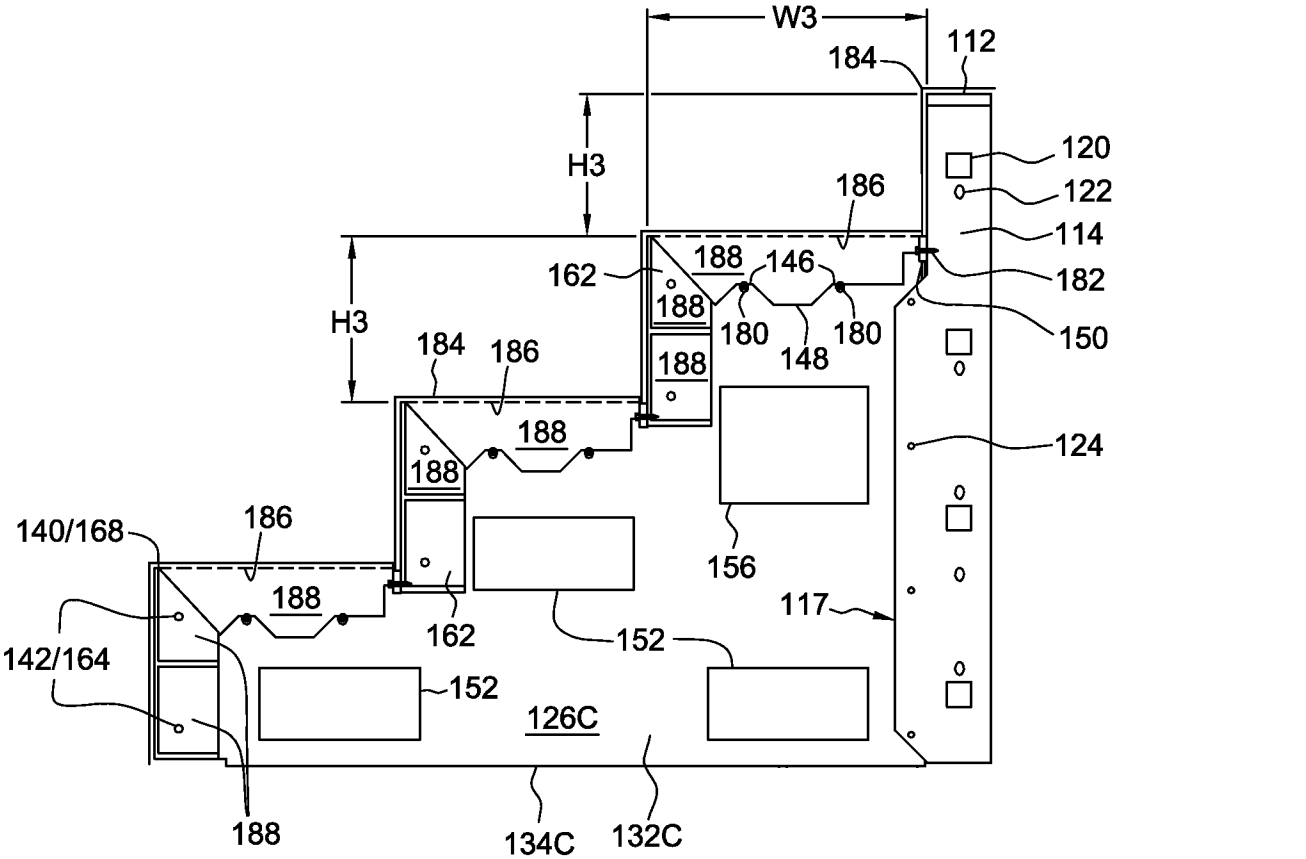
FIG. 11 is a side cross-sectional view of the exemplary pool stair form center brace of FIGS. 9A and 9B including a liner and filling material forming exemplary pool stairs.
Figure 13:
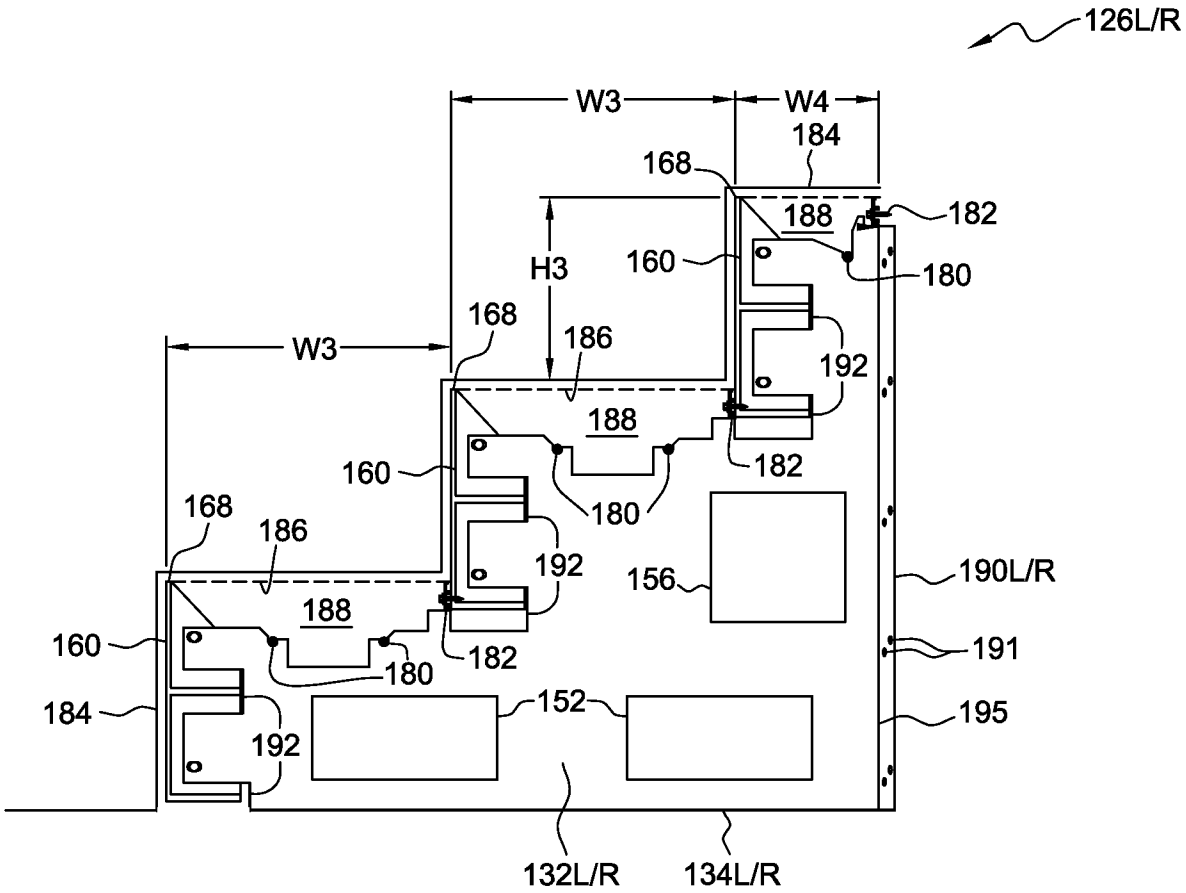
FIG. 13 is a side cross-sectional view of the exemplary pool stair form left and right braces of FIG. 13 including a liner and filling material forming exemplary pool stairs.
Figure 14:
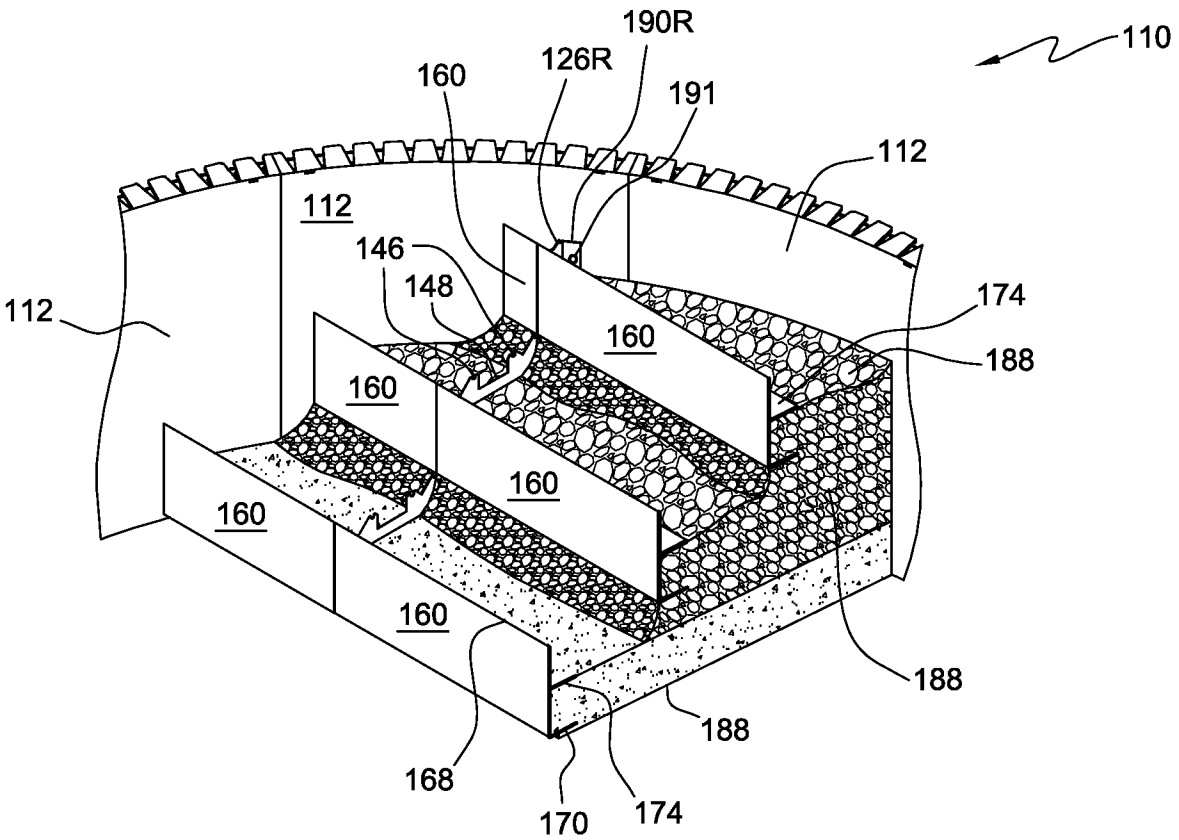
FIG. 14 is a perspective cross-sectional view of the second exemplary embodiment of a pool stair form of FIG. 7 partially filled with filling material.

In particular, as shown in FIG. 8 and FIG. 11 for the exemplary center brace 126C, and FIG. 13 for the exemplary left and right braces 126L/R, the portion of the braces adjacent the back edge 195 of the braces (the portion of the braces that is adjacent the wall panels 112 when installed) differs in width. As shown in FIG. 11 the exemplary center brace 126C includes a width W3 between the upper most riser edge or surface 138 and the back edge 195 substantially the same the width W3 between the other riser edges or surfaces 138 and liner support members 182 of the center brace 126C. In contrast, as shown in FIG. 13, the exemplary left and right braces 126L/R include a width W4 between the upper most riser edge or surface 138 and the back edge 195 that is substantially less than that (W3) of the exemplary center brace 126C and the width W3 between the other riser edges or surfaces 138 and liner support members 182 of the left and right braces 126L/R. The reduced width W4 of the back portion (adjacent the back edge 195) of the left and right braces 126L/R accounts for the curvature of the pool wall panels 112. As a result, the width W4 of the back portion of the left and right braces 126L/R and the width W3 of the back portion of the center brace 126C may be designed or configured for a particular pool wall panel radius.

As shown in FIG. 8, only the center brace 126C may be coupled to the wall panels 112 via wall panel insert 114 coupled in a seam between adjacent wall panels 112. In contrast, the back portion right and left braces 126L, 126R may include a flange member 190L, 190R, respectively, extending from the back edge 195, as shown in FIGS. 8 and 12A-13. The flange member 190L, 190R may include apertures or fixation points 191 for fastening the left and right braces 126L, 126R to the wall panels 112, as shown in FIG. 8. The flange members 190L, 190R of the left and right braces 126L, 126R may be angled with respect to the main body portions 132L, 132R thereof to account for the angled nature of the radiused wall panels 112. The flange members 190L, 190R of the left and right braces 126L, 126R may be angled with respect to the main body portions 132L, 132R thereof such that the braces 126L, 126R are substantially parallel to one another when they are coupled to the wall panels 112. Similarly, the flange members 190L, 190R of the left and right braces 126L, 126R may be angled with respect to the main body portions 132L, 132R thereof such that the left and right braces 126L, 126R are substantially parallel to the center brace 126C when they are coupled to the wall panels 112. As also shown in FIG. 8, the left brace 126L and the right brace 126R may differ in that the foot portions 134L, 134R and flange members 190L, 190R thereof are positioned or oriented on differing sides of the main body portions 132L, 132R thereof.

The left and right braces 126L, 126R may be coupled to the wall panels 112 via the flange members 190L, 190R. For example, fasteners may be used with the apertures or fixation points 191 to couple the left and right braces 126L, 126R to the wall panels 112. In some embodiments, once the braces 126C, 126L, 126R and step forms 160 are coupled or assembled with each other, the assembly may be dry-fit with the pool wall panels 112 and the wall panel insert 114 such that the user can mark the locations of the apertures or fixation points 191 of the flange members 190L, 190R of the left and right braces 126L, 126R on the wall panels 112. The assembly may then be removed from the wall panels 112 and the marked locations of the apertures or fixation points 191 of the flange members 190L, 190R of the left and right braces 126L, 126R on the wall panels 112 can be pre-drilled to accept fasteners therein, and be used for alignment, during final installation.

As the left and right braces 126L, 126R are not coupled to the wall panels 112 via wall panel insert 114, but rather the flange members 190L, 190R thereof, the step form braces 160 coupled to the left and right 126L, 126R may be positioned to one side of the left and right braces 126L, 126R as opposed to positioned on opposing sides thereof (as with the center brace 126C), as shown in FIG. 8 (i.e., the center brace 126C is sandwiched between step forms 160 on either side thereof). In this way, the total length of the length of the top, middle and bottom riser forms 160 (measured across the pool from wall panel 112 to wall panel 112) is not lengthened. While the arrangement of the center brace 126C between the riser forms 160 coupled thereto lengths the total length of the top, middle and bottom riser forms 160, the wall panel insert 114 between the wall panels 12 equally lengthens or widens the arcuate shape of the pool wall panels.

Figure 12A:
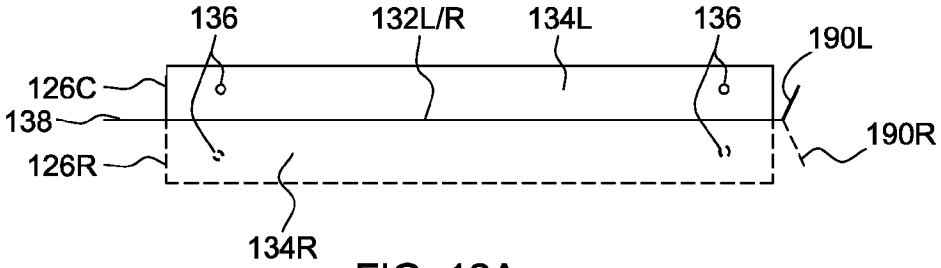
FIGS. 12A and 12B are top and side views, respectively, of exemplary pool stair form left and right braces of the second exemplary embodiment of the pool stair form of FIG. 7.
Figure 12B:
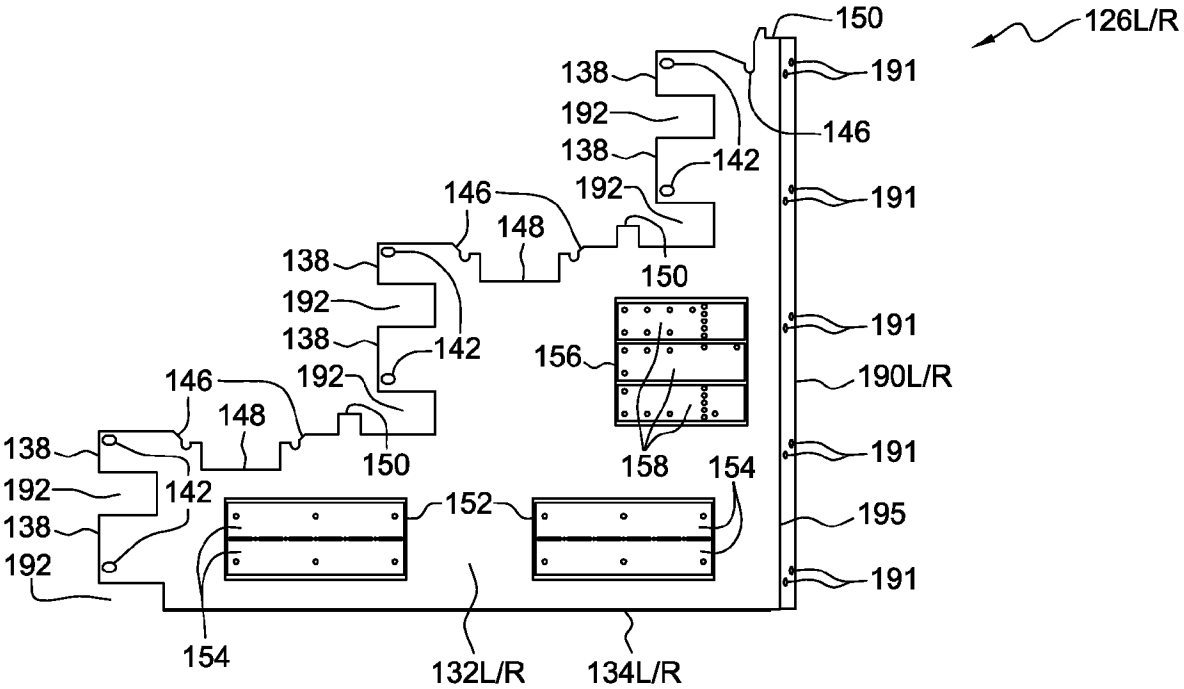

To facilitate such a side-attachment feature, the left and right braces 126L, 126R may include reliefs, channels, openings cutouts or the like 192 in the riser edges or surfaces 138, as shown in FIGS. 12B and 13. The reliefs 192 may extend from the riser edges or surfaces 138 and extend toward the back edge 195. The reliefs 192 may allow for or otherwise accommodate the bottom surface 70 and one or more rib member 74 of the riser forms 160 to penetrate into the main body portion 132L, 132R of the left and right braces 126L, 126R, as shown in FIG. 12B. In this way, a riser form 160 can pass through the left and right braces 126L, 126R and a pair of riser forms 160 may be coupled to the left and right braces 126L, 126R at one side of the riser edges or surfaces 138, such as via the apertures or fixation points 142 adjacent thereto. Thereby the total length of the length of the top, middle and bottom riser forms 160 (measured across the pool from wall panel 112 to wall panel 112) is not lengthened due to the attachment of the riser forms 160 to the left and right braces 126L, 126R.

As may be recognized by those of ordinary skill in the pertinent art based on the teachings herein, numerous changes and modifications may be made to the above-described and other embodiments of the present invention without departing from the spirit of the invention as defined in the claims. Accordingly, this detailed description of the illustrated and exemplary embodiments of the present invention is to be taken in an illustrative, as opposed to a limiting sense. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A pool stair form for forming stairs in a pool including pool wall panels, the pool stair form including:

at least one stair form brace configured to couple to at least one pool wall panel and extend therefrom in a first direction, the at least one stair form brace including at least one first fixation point; and a plurality of elongate riser forms including a front face, wherein the at least one stair form brace and the riser forms are configured to couple at the at least one first fixation point such that the riser forms extend in a second direction substantially contrasting the first direction and span substantially between opposing pool wall panels, wherein the front face of the riser forms form riser portions of the stairs when the riser forms are coupled to the at least one stair form brace and the at least one stair form brace is coupled to the at least one pool wall panel, where the riser forms and the at least one stair form brace are configured to receive filling material between the riser forms and the pool wall panels and about the at least one stair form brace when the riser forms are coupled to the at least one stair form brace and the at least one stair form brace is coupled to the at least one pool wall panel, the filling material forming tread portions of the stairs extending between adjacent riser portions of the stairs and opposing pool wall panels, and wherein the at least one stair form brace includes at least one aperture that allows the filling material to extend through the at least one stair form brace along the second direction.

2. The pool stair form of claim 1, wherein the riser forms includes at least one second fixation point at least at first ends thereof, and wherein the at least one stair form brace and the riser forms are configured to couple at the at least one first and at least one second fixation points.

3. The pool stair form of claim 1, further including at least one pool wall insert configured to couple between adjacent pool wall panels, and wherein at least one of the at least one stair form brace is configured to couple to the at least one pool wall insert to couple to the at least one pool wall panel.

4. The pool stair form of claim 1, wherein at least one of the at least one stair form brace is configured to directly couple to the at least one pool wall panel.

5. The pool stair form of claim 1, further including liner support members configured to be couple to at least one of the front face of the riser forms and the pool wall panels.

6. The pool stair form of claim 1, wherein the at least one stair form brace is configured to couple to at least one planar pool wall panel.

7. The pool stair form of claim 1, wherein the at least one stair form brace is configured to couple to at least one radiused pool wall panel.

8. The pool stair form of claim 7, wherein the at least one stair form brace includes:

a center stair form brace configured to couple to at least one pool wall panel and extend therefrom a first width along the first direction;

a left stair form brace configured to couple to at least one pool wall panel and extend therefrom a second width along the first direction; and a right stair form brace configured to couple to at least one pool wall panel and extend therefrom a third width along the first direction.

9. The pool stair form of claim 8, wherein the first width of the center stair form brace, the second width of the left stair form brace and the third width of the right stair form brace are configured such that when the center stair form brace, left stair form brace and right stair form brace are coupled to the at least one pool wall panel, the at least one first fixation point thereof are substantially aligned along the second direction.

10. The pool stair form of claim 8, wherein at least one of the second width of the left stair form brace and the third width of the right stair form brace differs from the first width of the center stair form brace.

11. The pool stair form of claim 1, wherein the at least one stair form brace includes reinforcement material holding surfaces proximate to the at least one first fixation point and spaced therefrom in a third direction that opposes the first direction.

12. The pool stair form of claim 11, wherein the reinforcement material holding surfaces are configured such that reinforcement material positioned thereon is positioned below the tread portions and is encapsulated by the filling material.

13. The pool stair form of claim 1, further including clips for coupling second ends of the riser forms with a pool wall panel when the riser forms are coupled to the at least one stair form brace and the at least one stair form brace is coupled to the at least one pool wall panel.

14. A pool stair form for forming stairs in a pool including pool wall panels, the pool stair form including:

at least one stair form brace configured to couple to at least one pool wall panel and extend therefrom in a first direction, the at least one stair form brace including at least one first fixation point and a plurality of elongate riser forms including a front face, wherein the at least one stair form brace and the riser forms are configured to couple at the at least one first fixation point such that the riser forms extend in a second direction substantially contrasting the first direction and span substantially between opposing pool wall panels, and wherein the front face of the riser forms form riser portions of the stairs when the riser forms are coupled to the at least one stair form brace and the at least one stair form brace is coupled to the at least one pool wall panel, where the riser forms and the at least one stair form brace are configured to receive filling material between the riser forms and the pool wall panels and about the at least one stair form brace when the riser forms are coupled to the at least one stair form brace and the at least one stair form brace is coupled to the at least one pool wall panel, the filling material forming tread portions of the stairs extending between adjacent riser portions of the stairs and opposing pool wall panels, and wherein the at least one stair form brace includes reinforcement material holding surfaces proximate to the at least one first fixation point and spaced therefrom in a third direction that opposes the first direction.

15. The pool stair form of claim 14, wherein the riser forms and the at least one stair form brace are configured to receive filling material between the riser forms and the pool wall panels and about the at least one stair form brace when the riser forms are coupled to the at least one stair form brace and the at least one stair form brace is coupled to the at least one pool wall panel, the filling material forming tread portions of the stairs extending between adjacent riser portions of the stairs and opposing pool wall panels.

16. The pool stair form of claim 15, wherein the at least one stair form brace includes at least one aperture that allows the filling material to extend through the at least one stair form brace along the second direction.

17. The pool stair form of claim 14, wherein the reinforcement material holding surfaces are configured such that reinforcement material positioned thereon is positioned below the tread portions and is encapsulated by the filling material.

18. The pool stair form of claim 17, further including reinforcement material positioned on the reinforcement material holding surfaces extending at least generally along the second direction.

19. The pool stair form of claim 14, further including clips for coupling second ends of the riser forms with a pool wall panel when the riser forms are coupled to the at least one stair form brace and the at least one stair form brace is coupled to the at least one pool wall panel.

20. A pool stair form for forming stairs in a pool including pool wall panels, the pool stair form including:

at least one stair form brace configured to couple to at least one pool wall panel and extend therefrom in a first direction, the at least one stair form brace including at least one first fixation point;

a plurality of elongate riser forms including a front face; and clips for coupling second ends of the riser forms with a pool wall panel when the riser forms are coupled to the at least one stair form brace and the at least one stair form brace is coupled to the at least one pool wall panel, wherein the at least one stair form brace and the riser forms are configured to couple at the at least one first fixation point such that the riser forms extend in a second direction substantially contrasting the first direction and span substantially between opposing pool wall panels, and wherein the front face of the riser forms form riser portions of the stairs when the riser forms are coupled to the at least one stair form brace and the at least one stair form brace is coupled to the at least one pool wall panel.

21. The pool stair form of claim 20, wherein the clips are removable portions of the at least one stair form brace.

22. The pool stair form of claim 20, wherein the at least one stair form brace includes reinforcement material holding surfaces proximate to the at least one first fixation point and spaced therefrom in a third direction that opposes the first direction.

23. A pool stair form for forming stairs in a pool including pool wall panels, the pool stair form including:

at least one stair form brace configured to couple to at least one radiused pool wall panel and extend therefrom in a first direction, the at least one stair form brace including at least one first fixation point; and a plurality of elongate riser forms including a front face, wherein the at least one stair form brace and the riser forms are configured to couple at the at least one first fixation point such that the riser forms extend in a second direction substantially contrasting the first direction and span substantially between opposing pool wall panels, wherein the front face of the riser forms form riser portions of the stairs when the riser forms are coupled to the at least one stair form brace and the at least one stair form brace is coupled to the at least one pool wall panel, wherein the at least one stair form brace includes:

a center stair form brace configured to couple to at least one pool wall panel and extend therefrom a first width along the first direction;

a left stair form brace configured to couple to at least one pool wall panel and extend therefrom a second width along the first direction; and a right stair form brace configured to couple to at least one pool wall panel and extend therefrom a third width along the first direction, and wherein the left and right stair form braces include reliefs proximate to the at least one first fixation point thereof that allow a riser form to extend past the respective stair form brace along the second direction such that first ends of adjacent riser forms are positioned on a first side of the respective stair form brace along the second direction.

24. A method of forming pool stairs in a pool including pool wall panels, the method including:

providing at least one stair form brace configured to couple to at least one pool wall panel and extend therefrom in a first direction, the at least one stair form brace including at least one first fixation point;

providing a plurality of elongate riser forms including a front face; and providing clips for coupling second ends of the riser forms with a pool wall panel when the riser forms are coupled to the at least one stair form brace and the at least one stair form brace is coupled to the at least one pool wall panel, the clips being removable portions of the at least one stair form brace, wherein the at least one stair form brace and the riser forms are configured to couple at the at least one first fixation point such that the riser forms extend in a second direction substantially contrasting the first direction and span substantially between opposing pool wall panels, and wherein the front face of the riser forms form riser portions of the stairs when the riser forms are coupled to the at least one stair form brace and the at least one stair form brace is coupled to the at least one pool wall panel.

25. The method of claim 24, wherein the riser forms include second at least one fixation point at least at first ends thereof, and wherein the at least one stair form brace and the riser forms are configured to couple at the at least one first and at least one second fixation points.

26. The method of claim 24, wherein the riser forms and at least one stair form brace are configured to receive filling material between the riser forms and the pool wall panels and about the at least one stair form brace when the riser forms are coupled to the at least one stair form brace and the at least one stair form brace is coupled to the at least one pool wall panel, the filling material forming tread portions of the stairs extending between adjacent riser portions of the stairs and opposing pool wall panels.

27. The method of claim 24, further including providing at least one pool wall insert configured to couple between adjacent pool wall panels, and wherein at least one of the at least one stair form brace is configured to couple to the at least one pool wall insert to couple to the to the at least one pool wall panel.

28. The method of claim 24, wherein at least one of the at least one stair form brace is configured to be directly coupled to the at least one pool wall panel.

29. The method of claim 24, further including providing liner support members configured to be couple to at least one of the front face of the riser forms and the pool wall panels.

30. The method of claim 24, wherein the at least one stair form brace includes reinforcement material holding surfaces proximate to the at least one first fixation point and spaced therefrom in a third direction opposing the first direction, and wherein the reinforcement material holding surfaces are configured such that reinforcement material positioned thereon is positioned below the tread portions and is encapsulated by the filling material.

31. A method of forming pool stairs in a pool including pool wall panels, the method including:

providing at least one stair form brace configured to couple to at least one pool wall panel and extend therefrom in a first direction, the at least one stair form brace including at least one first fixation point; and providing a plurality of elongate riser forms including a front face, wherein the at least one stair form brace and the riser forms are configured to couple at the at least one first fixation point such that the riser forms extend in a second direction substantially contrasting the first direction and span substantially between opposing pool wall panels, wherein the front face of the riser forms form riser portions of the stairs when the riser forms are coupled to the at least one stair form brace and the at least one stair form brace is coupled to the at least one pool wall panel, wherein the riser forms and at least one stair form brace are configured to receive filling material between the riser forms and the pool wall panels and about the at least one stair form brace when the riser forms are coupled to the at least one stair form brace and the at least one stair form brace is coupled to the at least one pool wall panel, the filling material forming tread portions of the stairs extending between adjacent riser portions of the stairs and opposing pool wall panels, and wherein the at least one stair form brace includes reinforcement material holding surfaces proximate to the at least one first fixation point and spaced therefrom in a third direction opposing the first direction, and wherein the reinforcement material holding surfaces are configured such that reinforcement material positioned thereon is positioned below the tread portions and is encapsulated by the filling material.

32. The method of claim 31, further including providing clips for coupling second ends of the riser forms with a pool wall panel when the riser forms are coupled to the at least one stair form brace and the at least one stair form brace is coupled to the at least one pool wall panel, the clips being removable portions of the at least one stair form brace.

* * * * *